US007240657B2

(12) United States Patent
Watanabe

(10) Patent No.: US 7,240,657 B2
(45) Date of Patent: Jul. 10, 2007

(54) LUBRICATING SYSTEM OF ENGINE

(75) Inventor: Yoshio Watanabe, Kakogawa (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 11/472,309

(22) Filed: Jun. 22, 2006

(65) Prior Publication Data

US 2006/0288976 A1 Dec. 28, 2006

(30) Foreign Application Priority Data

Jun. 27, 2005 (JP) ..... P2005-186707
Jun. 28, 2005 (JP) ..... P2005-188615

(51) Int. Cl.
*F01M 1/02* (2006.01)

(52) U.S. Cl. ..... 123/196 R; 184/6.5; 184/6.13

(58) Field of Classification Search ..... 123/196 R; 184/6.5, 6.8, 6.13
See application file for complete search history.

(56) References Cited

U.S. PATENT DOCUMENTS 6,889,651 B2 * 5/2005 Tanaka et al. ..... 123/196 R

FOREIGN PATENT DOCUMENTS

JP 8-288466 10/1994

OTHER PUBLICATIONS

Copending U.S. Appl.: inventor - Yoshio Watanabe; Title: "Shaft Arrangement Structure of Engine," filed Jun. 22, 2006;.

* cited by examiner

*Primary Examiner*—Noah P. Kamen
(74) *Attorney, Agent, or Firm*—Wenderoth, Lind & Ponack, L.L.P.

(57) ABSTRACT

The invention relates to a dry sump type or semidry sump type lubricating system of an engine in which a lubricating method executes an operation while keeping an inner side of a crank chamber in a dry state. An oil drain port is formed in a bottom surface of each of individual crank chambers partitioned into the cylinders, and a scavenging oil pump is provided so as to suck out oil to an oil reservoir portion which is isolated from each of the individual crank chambers. An oil collecting chamber communicating with a suction portion of the scavenging oil pump is provided in a lower side of the bottom wall in the crank chamber, and the oil drain port is communicated with the oil collecting chamber.

14 Claims, 21 Drawing Sheets

LUBRICATING SYSTEM OF ENGINE

BACKGROUND OF THE INVENTION

1. Field of the Invention

The present invention relates to a lubricating system of an engine, and more particularly to a dry sump type or semidry sump type lubricating system of an engine which is operated while keeping an inner side of a crank chamber in a dry state.

2. Description of the Related Art

A dry sump type lubricating system of an engine corresponds to a system in which an oil tank is installed as an oil reservoir portion separately from a crank case, and a predetermined amount of oil is reserved in the oil tank. On the other hand, a semidry sump type lubricating system utilizes a lower portion of a transmission room within a crank case as the oil reservoir portion, for example, by forming a partition wall between a crank chamber and the transmission room, without installing the separate type oil tank, and reserves the oil in the oil reservoir portion. Such semidry sump type lubrication system is disclosed in Japanese Unexamined Patent Publication No. H06-288466. Comparing with the dry sump type lubricating system, since it is unnecessary for the semidry sump type lubricating system to install the separate type oil tank, it is possible to save a cost and an arranging space for the oil tank, and it is possible to achieve a compact structure of the engine.

Either of the dry sump type lubricating system and the semidry sump type lubricating system is structured such that the oil is pressure fed to each oil supply positions of the engine from the oil reservoir portion by a feed oil pump, the oil after being used for lubrication coming down to the crank case or a bottom portion of an oil pan is forcibly pumped out to the oil reservoir portion by an additional oil pump (a so-called scavenging oil pump), and an inner side of the crank chamber is always kept in a dry state. Accordingly, it is possible to do away with a friction loss caused by agitation and splashing of the oil by the crank shaft (a crank web or the like), it is possible to improve an engine output, and it is possible to pressure feed and supply the oil to each oil supply position in a stable state.

In the dry sump type lubricating system or the semidry sump type lubricating system, it is necessary to quickly discharge the oil coming back to the crank chamber during the engine operation. However, in the case of a multi-cylinder in-line engine in which plural cylinders are arranged along the crank shaft, since the crank case is partitioned into plural crank chambers by a partition wall or more corresponding to cylinders, it is required that the oil can be quickly discharged from each of the crank chambers.

Conventionally, in order to discharge the oil in each crank chamber, an oil drain port is formed in a bottom surface or a side surface of one of plural crank chambers, and a communication hole is formed in the partition wall between the crank chambers. In other words, the oil coming back to the bottom surface of each crank chamber from the crank shaft or the like is collected to one crank chamber having the oil drain port via the communication hole of the partition wall, and is discharged from one oil drain port.

PROBLEM TO BE SOLVED BY THE INVENTION

In the in-line multi-cylinder engine having the dry sump type lubricating system or the semidry sump type lubricating system, if there is employed the system mentioned above, as the system of discharging the oil in each crank chamber, in which the communication hole is formed in the partition wall between the crank chambers, the oil in the other crank chamber is combined with one specific crank chamber having the oil drain port, and all the oil is discharged from the specific crank chamber, the following problems are generated. Specifically, because the oil in the other crank chamber having no oil drain port is required to pass through the communication hole to flow to the specific crank chamber having the discharge port, as well as because formation of a large communication hole in the partition wall supporting the crank shaft is difficult, it becomes difficult to quickly discharge the oil in the crank chamber, particularly the oil in the other crank chamber having no oil drain port. Further, it is necessary to form an oil passage surface sloped with respect to a horizontal surface in the bottom surface of the crank chamber to flow the oil to the specific crank chamber, and a shape of the bottom surface within each crank chamber becomes uneven.

Further, in the semidry sump type lubricating system, in order to maintain an amount of the oil necessary for the operation, an oil amount is inspected periodically (or sequentially), and the oil is supplies (or replaced). However, it is necessary to comprehend the oil amount in the entire of the engine at a time of supplying the oil in such a manner that the oil amount is within a predetermined range.

In the case that the operation is stopped for inspecting and supplying the oil, the returning oil from the lubricating positions such as the position on the crank shaft or the like is reserved in the crank chamber under the dry state little by little on the basis of an elapse of time. However, since the crank chamber and the oil reservoir portion such as the transmission room or the like are partitioned by the partition wall or the like, approximately the same oil level as that at the operating time is maintained in the transmission room, and on the other hand, the oil level which is significantly lower than the transmission room or the like is maintained in the crank chamber.

Accordingly, in order to accurately comprehend the oil amount in the entire of the engine, it is necessary to check the oil level within the oil reservoir portion and check the oil level within the crank chamber so as to estimate the oil remaining amount in the entire of the engine on the basis of both different oil levels. This requires a troublesome work for a user.

Further, in the case that the oil is supplied from an oil supply port provided in the oil reservoir portion, the oil does not flow into the crank chamber. Accordingly, only the oil level within the oil reservoir portion ascends, and it is necessary to form an oil inspection window having an inspection range corresponding to an ascending amount. As a result, it is necessary to make a dimension of the oil inspection window large, particularly a dimension in a vertical direction thereof.

Further, in order to accurately check the oil level in the oil reservoir portion and the oil level in the crank chamber respectively, it is necessary to form the oil inspection window in each of the oil reservoir portion and the crank chamber.

SUMMARY OF THE INVENTION

The present invention addresses the above described condition, and a first object of the present invention is to provide a lubricating system of a in-line multi-cylinder engine which can quickly discharge the oil coming back to a crank chamber for each of the cylinders, thereby intending to improve an output of the engine, and easily manufacturing the crank case.

A second object of the present invention is to provide a semidry sump type lubricating system of an engine which can easily comprehend an accurate oil amount of an entire engine at a time of inspecting the oil and supplying the oil, by setting oil levels in the oil reservoir portion and the crank chamber identical at a time when the operation is stopped.

In order to achieve the objects mentioned above, in accordance with the present invention, there is provided a lubricating system of an engine in which plural cylinders are provided so as to be arranged in a direction of a crank shaft, an oil pan is mounted to an oil pan mounting portion formed in a lower surface of a crank case, and a whole of a crank chamber in the crank case is partitioned into plural individual crank chambers by a partition wall so as to correspond to the cylinders in which the crank chamber has a bottom wall to isolate the crank chamber from the oil pan, comprising:

an oil drain port formed in the bottom wall of each of the individual crank chambers respectively;

a scavenging oil pump pumping out oil to an oil reservoir portion which is isolated from each of the individual crank chambers; and an oil collecting chamber communicating with a suction portion of the scavenging oil pump, wherein the oil collecting chamber is positioned under the bottom wall of the crank chamber, and the oil drain ports are communicated with the oil collecting chamber.

In accordance with the structure mentioned above, in a semidry sump type (or a dry sump type) in-line multi-cylinder engine, since the oil can be independently discharged from each oh the crank chambers for each of the cylinders, it is possible to quickly discharge the oil from each of the crank chambers, and it is possible to keep all the crank chambers in a good dry state. Accordingly, it is possible to effectively prevent a power loss caused by agitation and splashing of the oil by the crank shaft.

In the above lubricating oil system of the engine, preferably, the oil collecting chamber may be formed within the oil pan, and at least one of the oil drain ports may be communicated with the oil collecting chamber via an oil collecting passage formed in the bottom wall of the crank chamber.

In accordance with the structure mentioned above, it is unnecessary to form a volumetric capacity and an arranged position of the oil collecting chamber enough wide to get over all the oil drain ports, and it is possible to increase a design freedom of the volumetric capacity and the arranged position of the oil collecting chamber.

In the above lubricating oil system of the engine, preferably, the oil collecting passage may comprise a passage forming groove formed in the bottom wall of the crank chamber, and a bottom plate, a lower end of the passage forming groove may be opened, the bottom plate may close the lower opening end of the passage forming groove.

In accordance with the structure mentioned above, it is possible to easily form the oil collecting passage by a casting and a plate member without executing a specific piping.

In the above lubricating oil system of the engine, preferably, a strainer may be provided in the oil collecting chamber.

In accordance with the structure mentioned above, the strainer can be arranged by effectively using the lower space than the bottom wall of the crank chamber or the space within the oil pan, and it is possible to collectively clean the oil recovered from each of the crank chambers so as to recover within the oil reservoir portion, in the in-line multi-cylinder engine.

In the above lubricating oil system of the engine, preferably, an oil piping space may be formed between the bottom wall of the crank chamber and the oil pan, the oil collecting passage may be formed within the oil piping space, and an oil supply pipe for supplying the oil to each of lubricating positions of the engine may be provided in the oil piping space.

In accordance with the structure mentioned above, it is possible to effectively utilize the space between the bottom wall and the oil pan for the oil supply passage.

In the above lubricating oil system of the engine, preferably, a lower portion of a transmission room within the crank case may be formed as the oil reservoir portion, an oil suction chamber isolated from the oil collecting chamber may be formed in a lower portion than the bottom wall of the crank chamber, and the oil suction chamber may be communicated with a suction portion of a feed oil pump for supplying the oil to each of lubricating positions of the engine, and may be communicated with the oil reservoir portion.

In accordance with the structure mentioned above, since there is employed the semidry sump type in which the lower portion of the transmission room is formed as the oil reservoir portion, the separate type oil tank is not necessary, and it is possible to make the cost and the space for the tank unnecessary.

In the above lubricating oil system of the engine, preferably, the scavenging oil pump and the feed oil pump may be arranged in the transmission room, and a discharge portion of the feed oil pump may be communicated with a main gallery via an oil supply pipe, for supplying the oil to each of lubricating positions of the engine, arranged within an piping space formed between the bottom wall of the crank chamber and the oil pan.

In accordance with the structure mentioned above, since the oil supply path from the oil pump to the main gallery is formed by utilizing the oil piping within the oil pan, it is possible to effectively utilize the space within the oil pan, and even if an oil leakage is generated in a connection portion of the oil piping, it is possible to prevent the oil from leaking to an external portion by the oil pan.

In the above lubricating oil system of the engine, preferably, a mounting face for the oil collecting chamber in the oil pan may be formed in the oil pan mounting portion of the crank case, the mounting face corresponds to an upper end of a peripheral wall of the oil collecting chamber, a portion of the mounting face may be opened so as to communicate the passage forming groove to the oil collecting chamber, and a mounting face supplement member which forms approximately the same surface as the mounting face may be mounted to the opening portion of the mounting face.

In accordance with the structure mentioned above, it is possible to easily form the oil collecting passage as the passage forming groove at a time of casting the crank case, and it is possible to secure a sealing performance in an entire periphery of the oil collecting chamber by mounting the mounting face supplement member.

In the above lubricating oil system of the engine, preferably, an oil collecting passage is provided under the bottom wall so as to flow the oil from the drain port to the oil collecting chamber, a regulating hole may be provided to the oil collecting passage or the bottom wall so as to communicate the oil collecting chamber with the oil reservoir portion, and a cross sectional area of the regulating hole is set such that an amount of the oil flowing to the oil collecting chamber from the oil reservoir portion through the regulating hole and the oil collecting passage becomes smaller than an amount of the oil pumped out to the oil reservoir portion from the oil collecting chamber by the scavenging oil pump.

In accordance with the structure mentioned above, since it is possible to equalize an oil level within the oil reservoir portion (the transmission room or the like) and an oil level within the crank chamber at a time of stopping the operation so as to inspect and supply the oil, on the basis of the distribution of the oil via the regulating hole, and it is possible to easily comprehend the accurate oil amount in the entire of the engine. Accordingly, it is possible to easily and accurately execute the oil supplying work to a predetermined range of oil amount. Further, at the operating time, since it is possible to pump out the more oil amount than the oil amount coming back to the oil collecting chamber side through the regulating hole to the oil reservoir portion side by the scavenging oil pump, it is possible to keep the crank chamber in the dry state.

In the above lubricating oil system of the engine, preferably, the oil reservoir portion may be provided with an oil inspection window through which an oil level within the oil reservoir portion may be visible from the outside.

In accordance with the structure mentioned above, it is possible to accurately check out the oil level of the entire within the engine only by checking out the oil level of the oil reservoir portion. Further, since the oil inspection window is provided at only one position, it is easy to manufacture and work the crank case or the like.

Further, in accordance with the other invention, there is provided a semidry sump type lubricating system of an engine in which a lower portion of a transmission room of a crank case is formed as an oil reservoir portion isolated from a crank chamber, comprising:

an oil collecting chamber positioned under a bottom wall of the crank chamber;

a scavenging oil pump pumping out oil from the oil collecting chamber to the oil reservoir portion;

a feed oil pump for supplying the oil from the oil reservoir portion to each of lubricating positions of the engine;

an oil collecting passage provided under the bottom wall so as to flow the oil from a drain port of the crank chamber to the oil collecting chamber, and a regulating hole provided to the oil collecting passage or the bottom wall so as to communicate the oil collecting chamber with the oil reservoir portion, wherein a cross sectional area of the regulating hole is set such that an amount of the oil flowing to the oil collecting chamber from the oil reservoir portion through the regulating hole and the oil collecting passage becomes smaller than an amount of the oil pumped out to the oil reservoir portion from the oil collecting chamber side by the scavenging oil pump.

In accordance with the structure mentioned above, since it is possible to equalize an oil level within the oil reservoir portion (the transmission room or the like) and an oil level within the crank chamber at a time of stopping the operation so as to inspect and supply the oil, on the basis of the distribution of the oil via the regulating hole, and it is possible to easily comprehend the accurate oil amount in the entire of the engine. Accordingly, it is possible to easily and accurately execute the oil supplying work to a predetermined range of oil amount. Further, at the operating time, since it is possible to pump out the more oil amount than the oil amount coming back to the oil collecting chamber side through the regulating hole to the oil reservoir portion side by the scavenging oil pump, it is possible to keep the crank chamber in the dry state.

In the above other lubricating oil system of the engine, preferably, the regulating hole may be formed bottom portion of the oil collecting passage.

In accordance with the structure mentioned above, since a position of the regulating hole is formed the bottom of the oil collecting passage, a head pressure of the oil applied to the regulating hole becomes large, the oil level is approximately equalized quickly between the oil reservoir portion and the crank chamber (the oil suction chamber) at a time of the operation, and it is possible to quickly comprehend the oil amount in the entire of the engine at a time of supplying the oil.

In the above other lubricating oil system of the engine, preferably, the oil collecting passage may comprise a passage forming groove formed the bottom wall of the crank chamber, and a bottom plate closing a lower opening end of the passage forming groove, the regulating hole is formed to the bottom plate.

In accordance with the structure mentioned above, since the regulating hole is formed in the bottom plate, it is easy to form the regulating hole comparison with the case that the regulating hole is formed in the crank case.

In the above other lubricating oil system of the engine, preferably, the oil reservoir portion may be provided with an oil inspection window through which an oil level within the oil reservoir portion may be visible from the outside.

In accordance with the structure mentioned above, it is possible to accurately check out the oil level of the entire within the engine only by checking out the oil level of the oil reservoir portion. Further, since the oil inspection window is provided at only one position, it is easy to manufacture and work the crank case or the like.

BRIEF DESCRIPTION OF THE DRAWINGS

The above and other objects, features, and advantages of the present invention will be become more apparent from the following description taken in connection with the accompanying drawings, in which.

DETAILED DESCRIPTION OF THE PREFERRED EMBODIMENTS

EMBODIMENTS (Structure of Entire of Engine)

FIGS. 1 to 26 show an embodiment of a lubricating system of an in-line two-cylinder engine for a motor cycle, particularly the lubricating system is a semidry type lubricating system.

[Shape of Crank Case]

Figure 1:
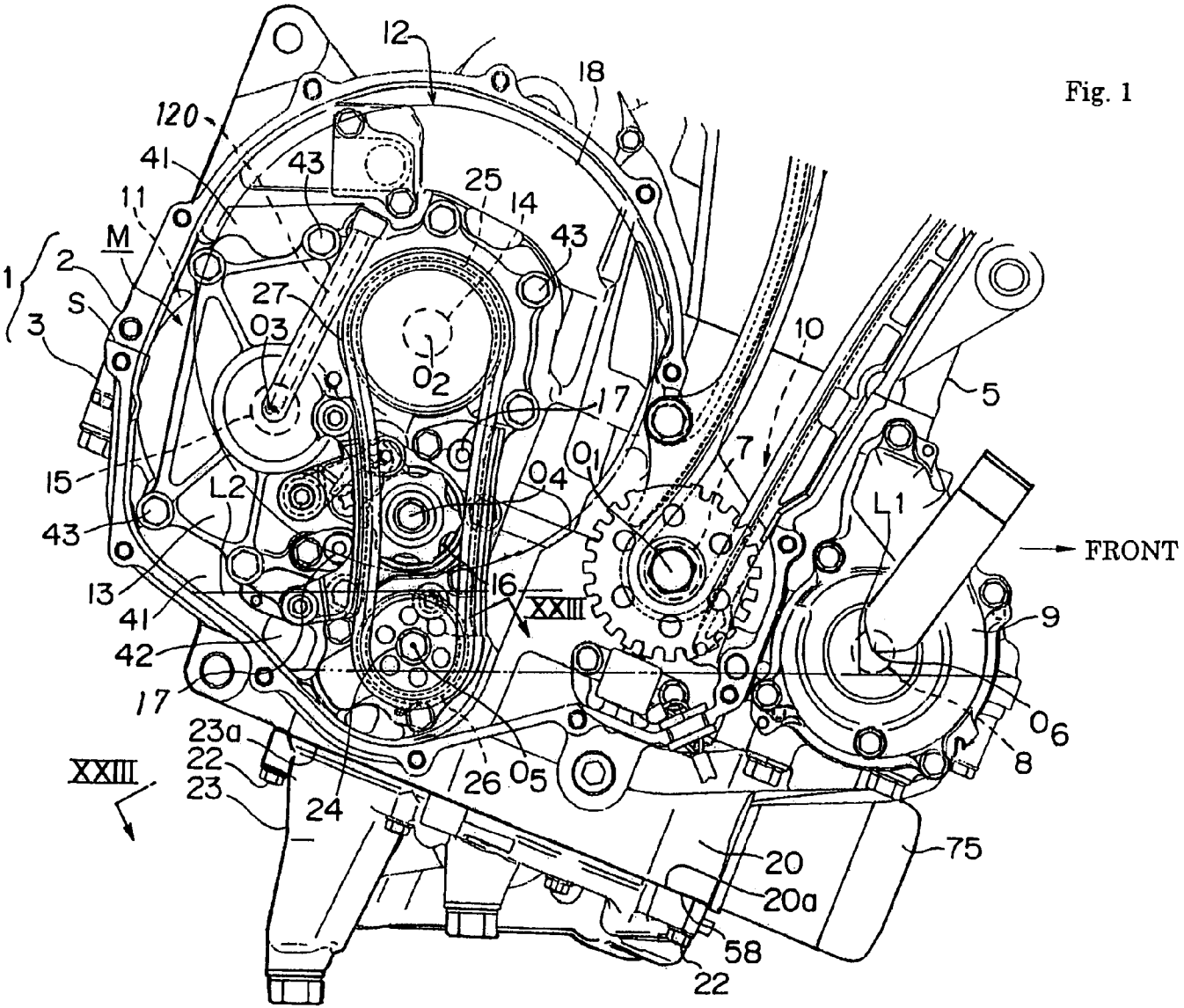
FIG. 1 is a right side view of a crank case of a in-line two-cylinder engine for a motor cycle provided with a embodiment of a lubricating system in accordance with an embodiment of the present invention, and the crank case is shown in a state in which a clutch cover is detached.

FIG. 1 is a right side view of a crank case 1 in a state in which a clutch cover 88 (refer to FIG. 2) is detached. As a matter of convenience for explanation, a description will be given below on the assumption that a side in which a cylinder 5 is located (a vehicle forward moving side) is set to "front side", and a lateral direction (an axial direction of a crank shaft 7) in the case of viewing from a rear side, that is, viewing from a rider is set to "lateral direction".

In FIG. 1, the crank case 1 comprises an upper crank case member 2 and a lower crank case member 3 which is detachable from the upper crank case 2. The upper crank case member 2 and the lower crankcase member 3 are coupled by a mating face S. The cylinder 5 is fastened to an upper surface in a front half portion of the upper crankcase member 2 in a forward tilting attitude, and a cylinder head and a head cover which are not illustrated are sequentially fastened to an upper surface of the cylinder 5. A front half portion of the crank case 1 forms a crank chamber 10 (refer to FIGS. 3 and 4) accommodating or housing a crank shaft 7. A balancer shaft 8 is arranged in a front portion of the crank chamber 10, and a water pump 9 is provided in a right end portion of the balancer shaft 8.

A rear half portion of the crank case 1 forms a transmission room 11 (refer to FIGS. 3 and 4) accommodating or housing a cassette type transmission assembly M. The cassette type transmission assembly M is structured such as to support an input shaft 14 for change gear, an output shaft 15 for change gear, a change drum 16, a shift fork shaft 17 and the like to a shaft support member 13 independent from the crank case 1. The transmission assembly M is formed as one unit, and is inserted into the transmission room 11 from a right side, and the shaft support member 13 is detachably fixed to a transmission mounting wall 41 formed in each of the crank case members 2 and 3 by a bolt 43 (partially denoted by reference numeral). A drive sprocket 25 for driving a pump is installed to a right end portion of the input shaft 14, and a multi-disc friction clutch 18 shown by a virtual line is installed thereto. A chain 27 for driving the pump is wound between the drive sprocket 25 and a sprocket 26 of a common pump shaft 24 arranged in a front lower end portion of the transmission room 11, thereby transmitting a rotation of the input shaft 14 to the common pump shaft 24.

An oil pan mounting portion 20 for an oil pan 23 protruding to a lower side is formed in a lower surface of a bottom wall of the lower crankcase member 3 so as to be integral with the lower crankcase member 3, a lower end surface of the oil pan mounting portion 20 is formed as a mounting face 20*a* sloping forward downward, and an oil pan 20 is fastened to the mounting face 20*a* by a plurality of mounting bolts 22.

Figure 25:
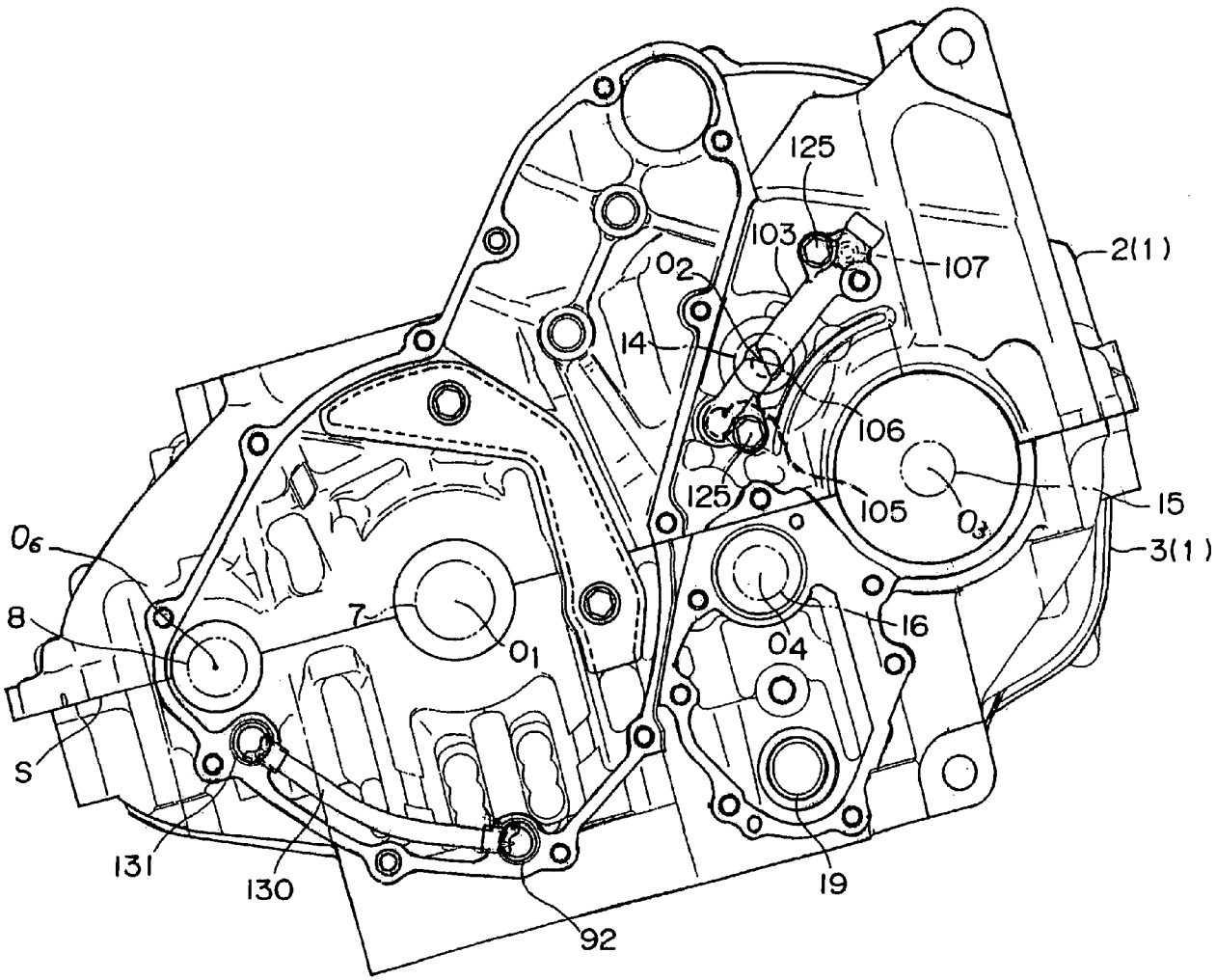
FIG. 25 is a left side view of the crank case in FIG. 1.

FIG. 25 is a left side view of the crank case 1. An shaft center O1 of the crank shaft 7 (FIG. 1), an shaft center O6 of the balancer 8 (FIG. 1) and an shaft center O3 of the output shaft 15 (FIG. 1) are positioned on the mating face S of the upper and lower crankcase members 2 and 3, an shaft center O2 of the input shaft 14 (FIG. 1) is positioned in an upper side than the mating face S, and an shaft center O4 of the change drum 16 (FIG. 1) is positioned in a lower side than the mating face S. A change shaft 19 (FIG. 1) having a change pedal is arranged in a lower side of the change drum 16.

Figure 3:
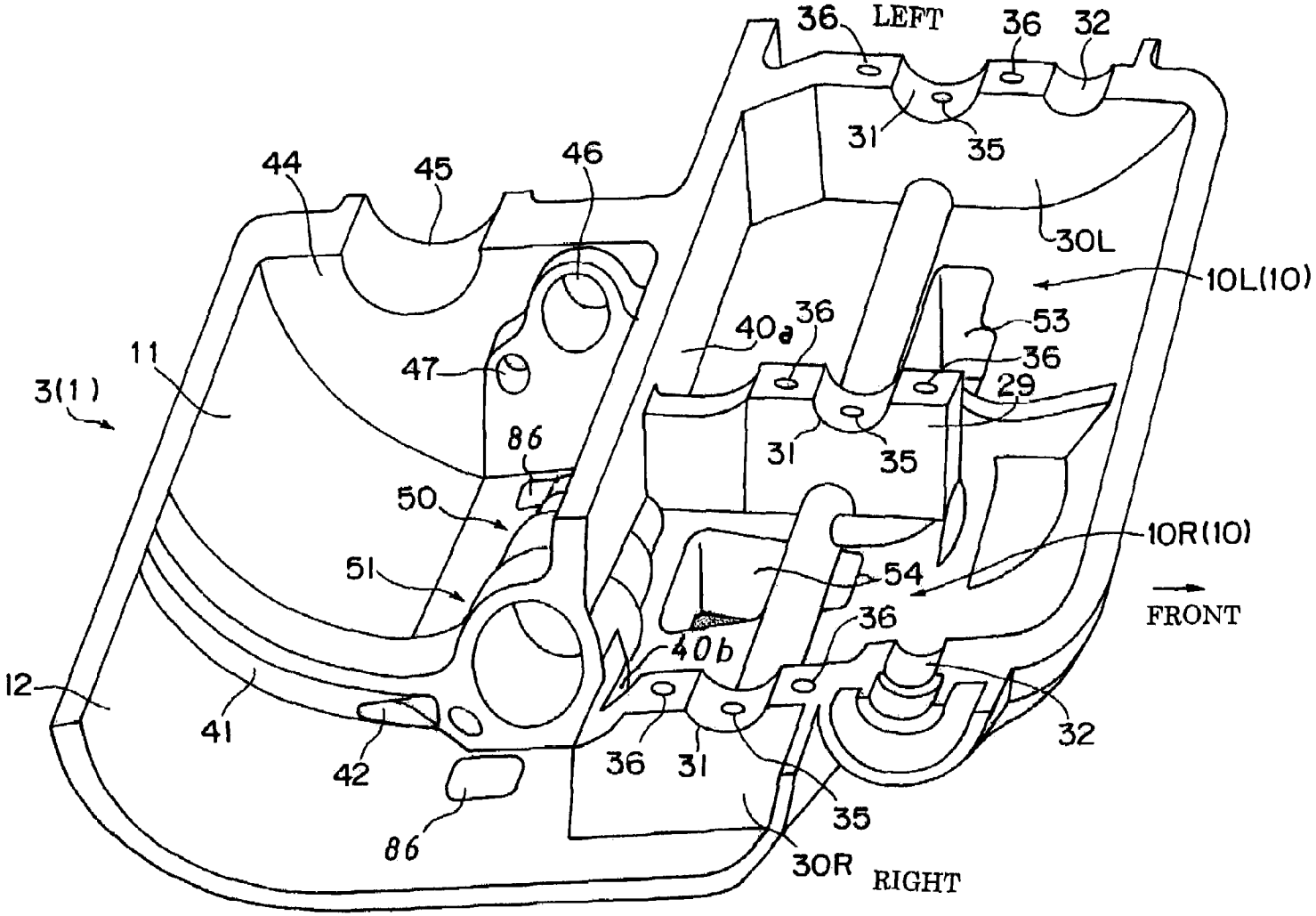
FIG. 3 is a perspective view in the case of viewing a lower crankcase member of the engine in FIG. 1 from a right front upper side.
Figure 4:
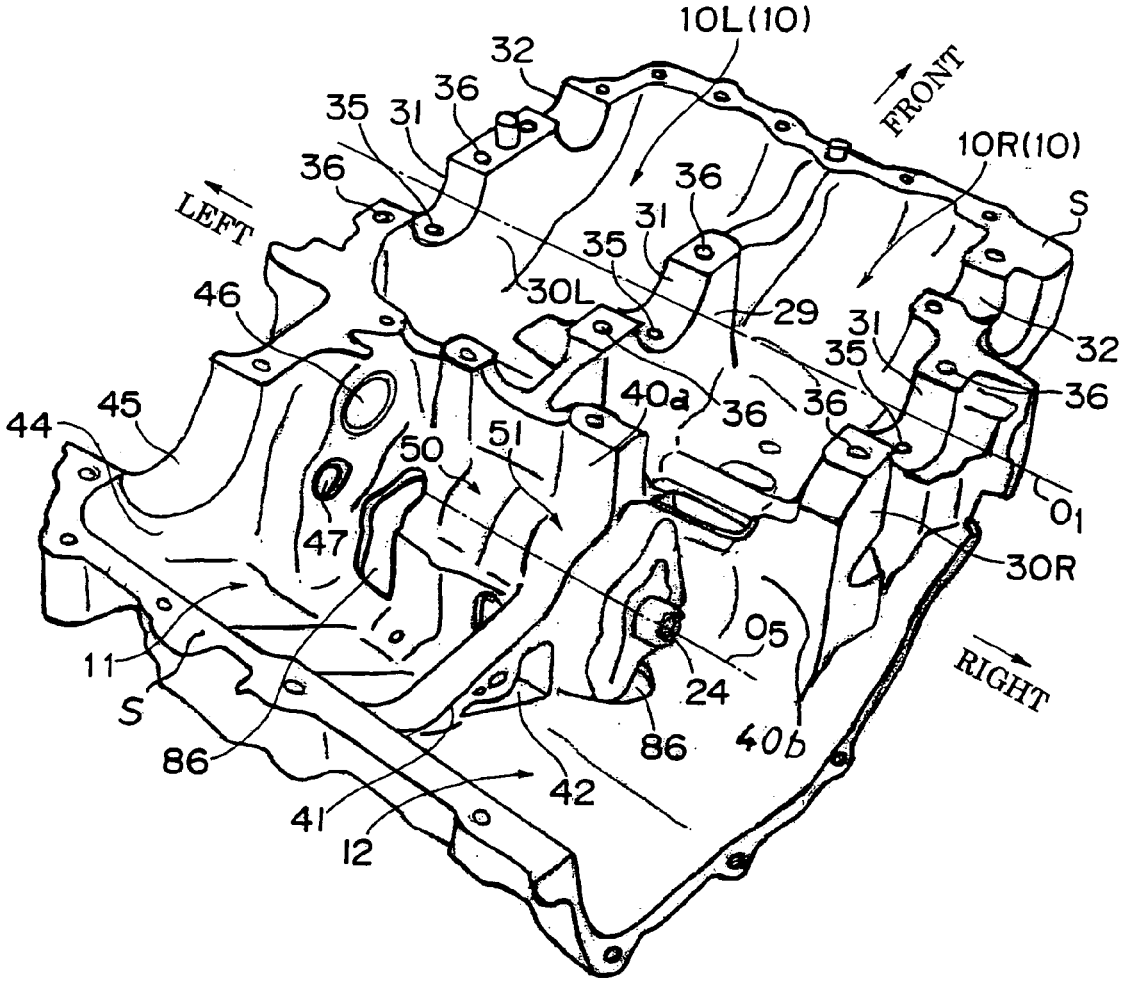
FIG. 4 is a perspective view in the case of viewing the lower crankcase member in FIG. 1 from a right rear upper side.

FIG. 3 is a brief perspective view in the case of viewing the lower crankcase member 3 from a right front upper side, and FIG. 4 is a perspective view in the case of viewing the lower crankcase member 3 from a right rear upper side. In FIG. 3, since the engine is the in-line two-cylinder engine, the crank chamber 10 is partitioned into two individual chambers, i.e., a left individual crank chamber (a first individual crank chamber) 10L and a right individual crank chamber (a second individual crank chamber) 10R by a partition wall 29 formed in a center portion in the lateral direction. Crank portions (crank webs or the like) of the crank shaft coupling to pistons in the respective cylinders are accommodated in the left and right individual crank chambers 10L and 10R. A half-shaped bearing concave portion 31 for supporting the crank shaft is formed in each of upper end surfaces of left and right side walls 30L and 30R and the partition wall 29 of the crank chamber 10. A half-shaped bearing concave portion 32 for supporting the balancer shaft 8 (refer to FIG. 1) is formed in front portions of the left and right side walls 30L and 30R of the crank chamber 10. An oil supply hole 35 for lubricating the crank shaft 7 is formed in a lower end of each of the bearing concave portions 31, and fastening bolt insertion holes 36 are formed in front and rear sides of each of the bearing concave portions 31.

In FIG. 4, a clutch room 12 is formed in a right side of the transmission room 11 via the transmission mounting wall 41, and in order to utilize the lower portion of the transmission room 11 and the lower portion of the clutch room 12 as the oil reservoir portion, a partition wall 40*a* having a height corresponding to the mating face S is formed between the transmission room 11 and the crank chamber 10, and a partition wall 40*b* lower than the mating face S is formed between the clutch room 12 and the crank chamber 10. Further, a communication hole 42 communicating the lower end portion of the transmission room 11 and the lower end portion of the clutch room 12 so as to circulate the oil is formed in the lower end portion of the transmission mounting wall 41, whereby it is possible to simultaneously utilize the lower portion of the clutch room 12 and the lower portion of the transmission room 11 as the oil reservoir portion.

In a left side wall 44 of the transmission room 11, there is formed a half-shaped bearing concave portion 45 for supporting the output shaft 15 (refer to FIG. 25), and there are further formed a cylindrical concave portion 46 for supporting the change drum 16 (refer to FIG. 1), a concave portion 47 for the shift fork shaft 17 (refer to FIG. 1), and the like.

In a lower end portion of the partition wall 40*a*, that is, a front lower end portion of the transmission room 11, there are provided a feed oil pump 50 for pressure feeding the oil within the oil reservoir portion to each of the lubricating positions, and a scavenging oil pump (a collection oil pump) 51 for recovering the used oil coming back from the lubricating positions such as the crank shaft and the like to the oil reservoir portion, in parallel on the shaft center O5 of the common pump shaft 24.

[Oil Discharge Structure of Crank Chamber]

Figure 5:
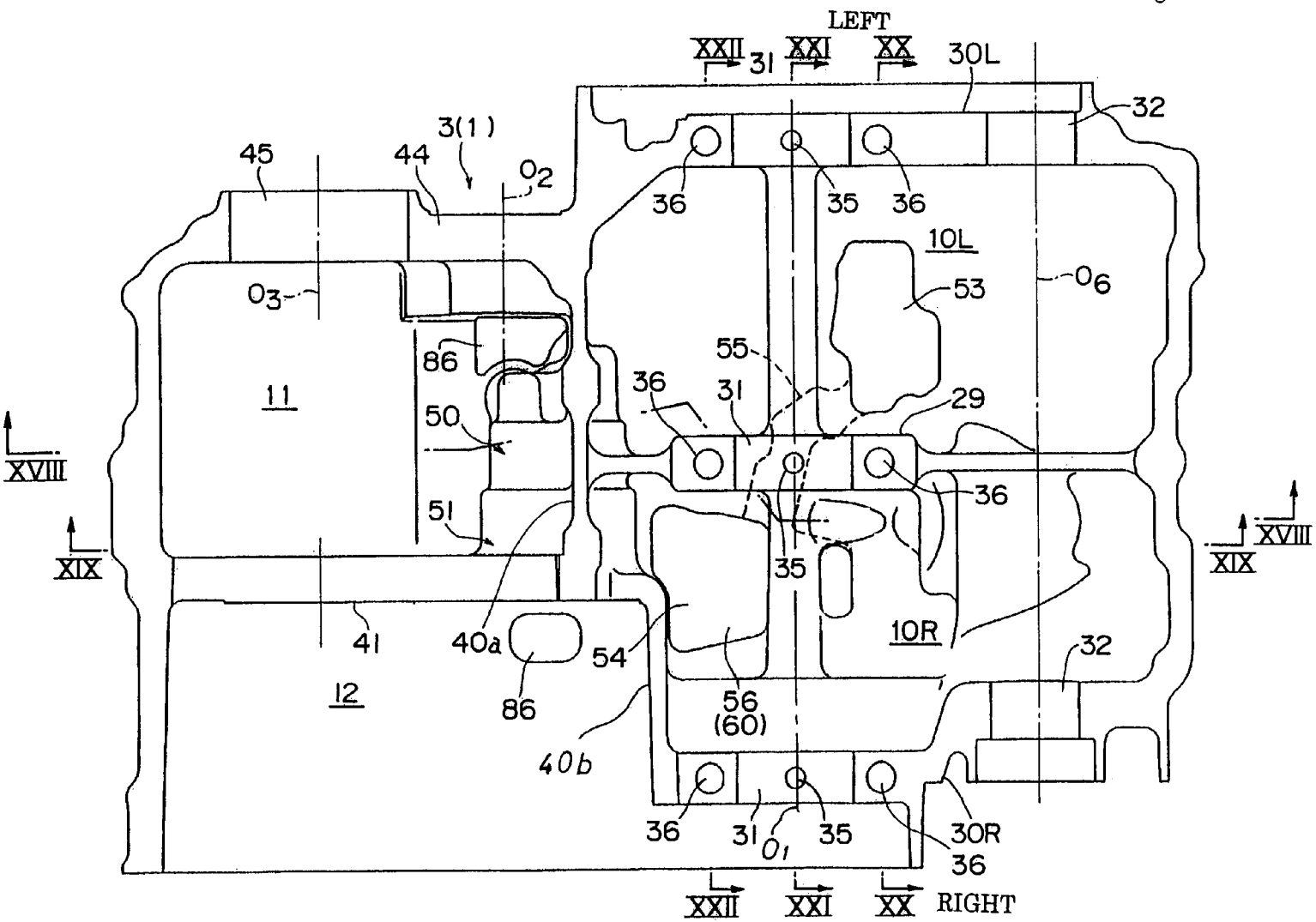
FIG. 5 is a plan view of the lower crankcase member in FIG. 1.

FIG. 5 is a plan view of the lower crankcase member 3. A left oil drain port 53 is formed at an approximately intermediate portion in a longitudinal direction in the bottom surface of the left individual crank chamber 10L. Above the intermediate portion in which the left oil drain port 53 is formed is an approximately lowest portion of the bottom surface of the left individual crank chamber 10L. A right oil drain port 54 is formed at a rear half portion in the bottom surface of the right crank chamber 10R. Above the rear half portion in which the right oil drain port 54 is formed is an approximately lowest portion of the bottom surface of the right individual crank chamber 10R. Thereby, the oil coming back to each of the bottom surfaces of the individual crank chambers 10L and 10R from the crank shaft portion is independently discharged from each of the oil drain ports 53 and 54 per the left and right individual crank chambers 10L and 10R.

An oil collecting passage 55 extending to a right rear side across the lower portion of the partition wall 29 from the left oil drain port 53 is formed in the lower surface of the bottom wall of the lower crankcase member 3 (the bottom walls of the individual crank chambers 10L and 10R). A right end of the oil collecting passage 55 is communicated with a space portion 56 formed in the lower side of the right oil drain port 54. The space portion 56 communicates an oil collecting chamber 60 mentioned below.

[Shape of Oil Pan]

Figure 12:
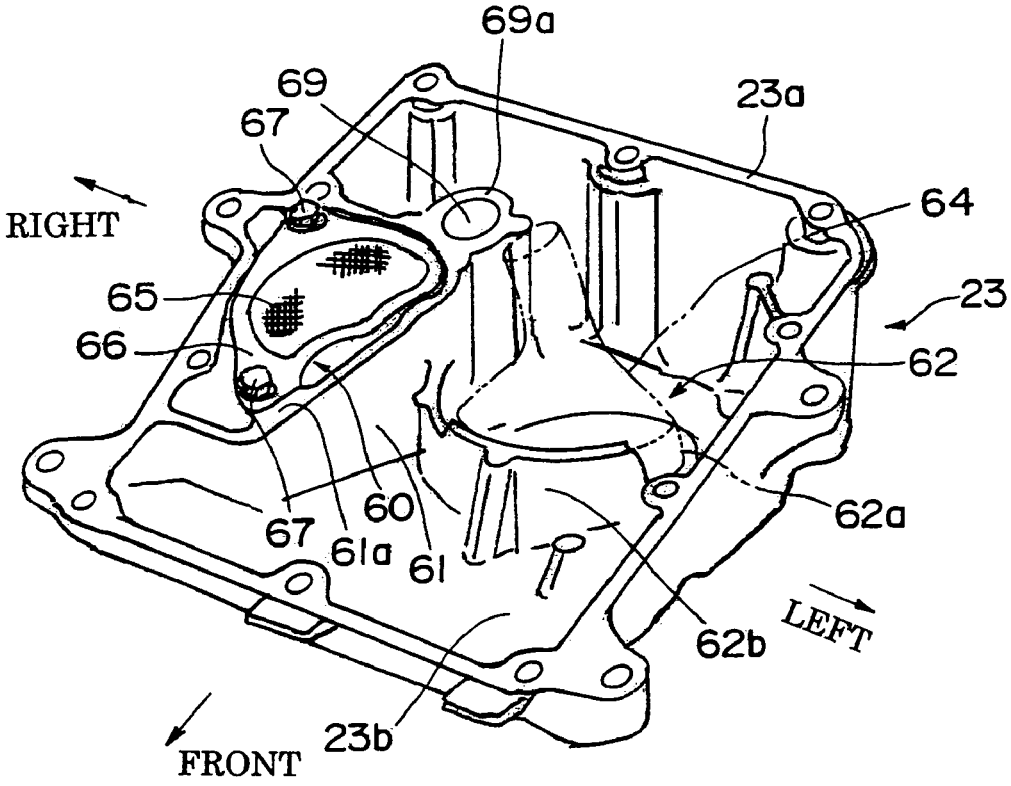
FIG. 12 is a perspective view in the case of viewing the oil pan in FIG. 1 from a left front upper side.
Figure 13:
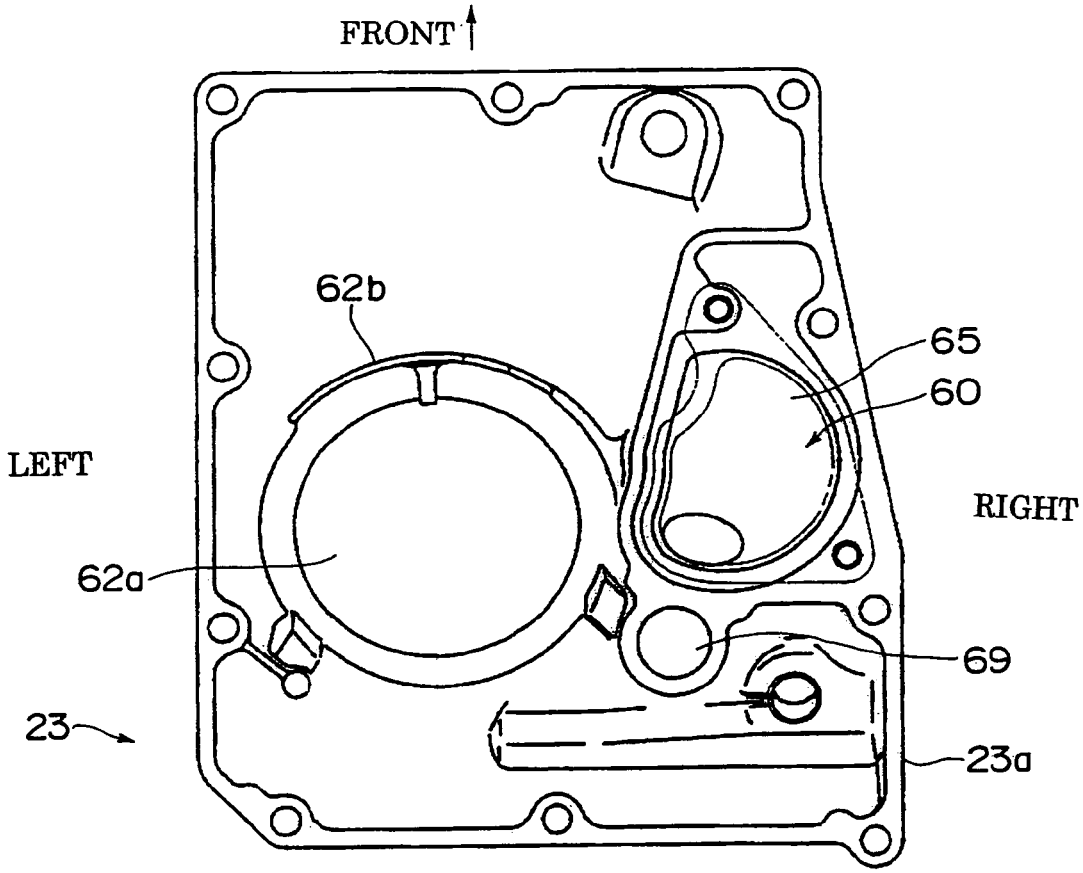
FIG. 13 is a plan view of the oil pan in FIG. 1.

FIG. 12 is a perspective view in the case of viewing the oil pan 23 from a left front upper side, and FIG. 13 is a plan view of the oil pan 23. In FIG. 12, the oil pan 23 is formed in an approximately right angled triangular shape as seen in the axial direction of the crank shaft, that is, in a side view, an upper end mating surface 23*a* of the oil pan 23 is sloped front downward, and a bottom wall 23*b* of the oil pan 23 is formed approximately horizontal. The oil collecting chamber 60 is formed within the oil pan 23 so as to be adjacent to a right side wall of the oil pan 23, and a remaining space having a large volumetric capacity and partitioned by a peripheral wall 61 of the oil collecting chamber 60 is formed as an oil suction chamber 62. The oil suction chamber 62 is utilized as an oil reservoir portion too.

A circular mounting face 62*a* for arranging a strainer (a primary filter) 64 is formed in a bottom surface of the oil suction chamber 62, and a circular arc baffle plate 62*b* is formed in a rising manner in a front portion of the mounting face 62*a*.

A strainer 65 constituted by a wire netting is accommodated in the oil collecting chamber 60, and is fixed to an upper end portion of the peripheral wall 61 of the oil collecting chamber 60 by a presser plate 66 and a bolt 67. An upper end mating face 61*a* of the peripheral wall 61 is formed within the same surface as the upper end mating surface 23*a* of the outer peripheral wall of the oil pan 23.

A collection oil suction passage 69 in which a lower end portion is communicated with the lower end portion of the oil collecting chamber 60 is formed in a rear side of the oil collecting chamber 60, and an upper end mating surface 69*a* of the collection oil suction passage 69 is formed within the same surface as the mating surface 23*a* of the oil pan 23. In other words, the upper end mating surface 23*a* of the oil pan 23, the upper end mating face 61*a* of the peripheral wall 61 of the oil collecting chamber 60 and the upper end mating surface 69*a* of the collection oil suction passage 69 are aligned on the same surface.

Figure 19:
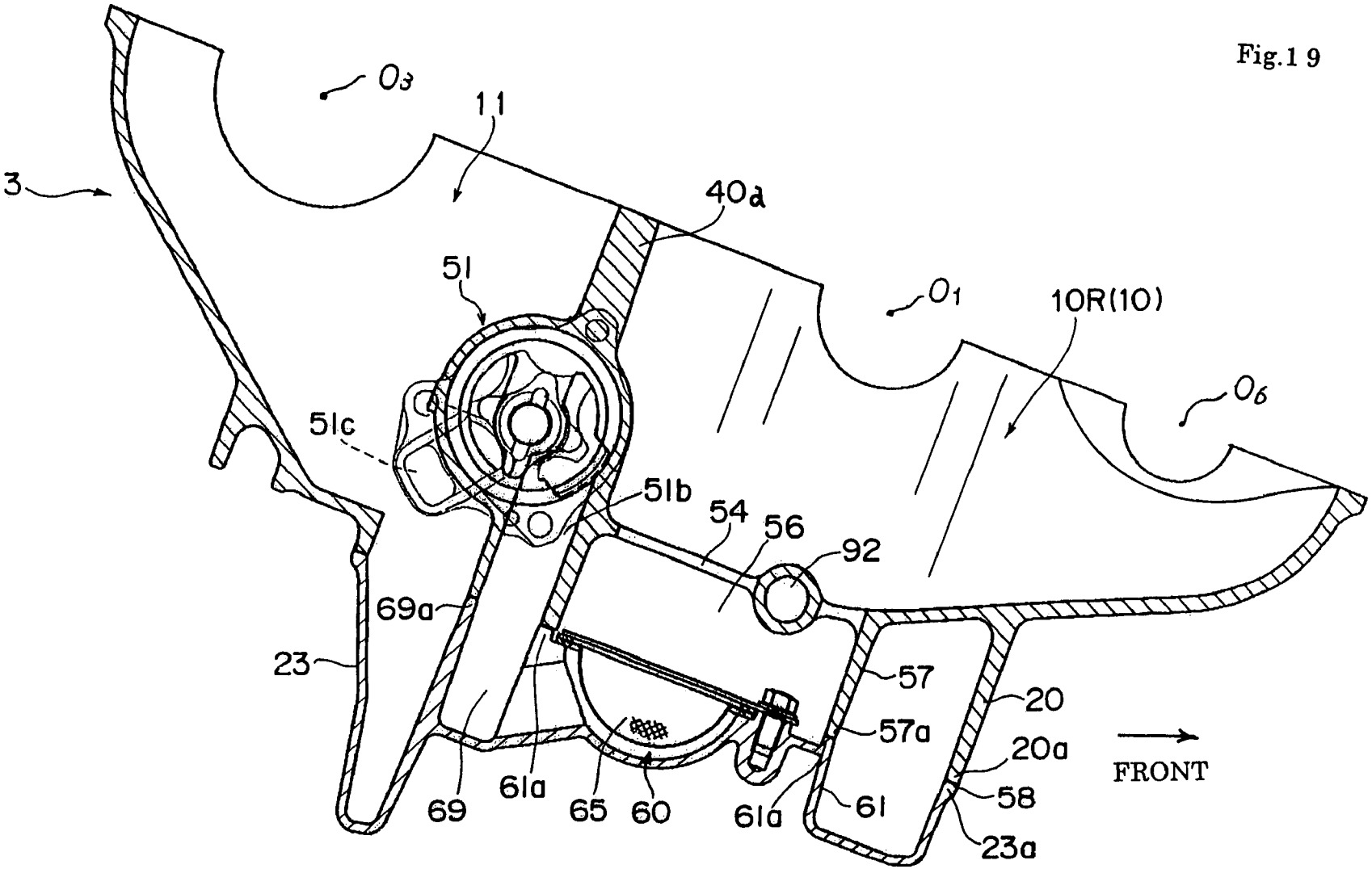
FIG. 19 is a cross sectional view of the lower crankcase member in FIG. 5 along a line XIX-XIX.

FIG. 19 is a cross sectional view along a line XIX-XIX in FIG. 5. As mentioned above, since each of the mating surfaces 23*a*, 61*a* and 69*a* in the oil pan 23 side is provided on the same surface, a common gasket 58 can be pinched between the oil pan mounting portion 20 of the lower crank case member 3 and the oil pan 23. Namely, the common gasket 58 is utilized as a seal between the mating surfaces 23*a*, 61*a* and 69*a* of the oil pan 23 side, and the mounting face 20*a* for the oil pan 23, a lower end mounting face 57*a* of the peripheral wall 57 of the space portion 56 and a lower end surface of a suction portion 51*b* of the scavenging oil pomp 51 of the oil pan mounting portion 20 side.

The oil collecting chamber 60 is formed just below the right oil drain port 54 of the right individual crank chamber 10R and the space portion 56 of the oil pan mounting portion 20, thereby the oil discharged from the right oil drain port 54 directly flows into the oil collecting chamber 60 through the space portion 56. On the other hand, the oil discharged from the left oil drain port 53 of the left individual crank chamber 10L in FIG. 5 flows into the space portion 56 through the oil collecting passage 55 formed in the lower surface of the bottom wall (the bottom walls of the crank chambers 10L and 10R) of the crank case 1, then flows into the lower oil collecting chamber 60.

[Strainer]

Figure 14:
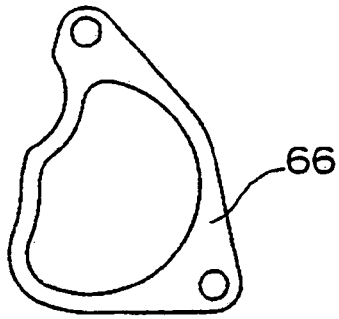
FIG. 14 is a plan view of a presser plate of a strainer.
Figure 15:
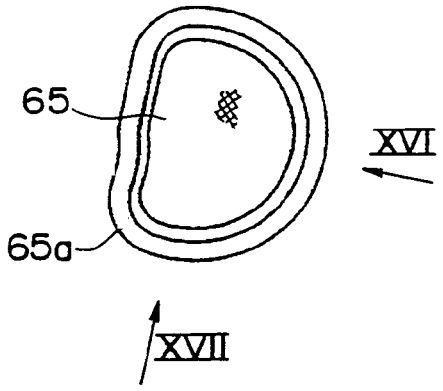
FIG. 15 is a plan view of the strainer.
Figure 16:
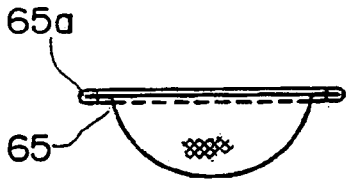
FIG. 16 is a view of the strainer in FIG. 15 as seen from an arrow XVI.
Figure 17:
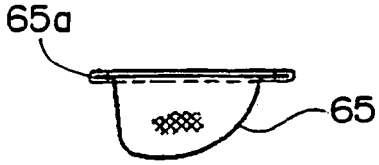
FIG. 17 is a view of the strainer in FIG. 15 as seen from an arrow XVII.

FIG. 14 is a plan view of the presser plate 66, FIG. 15 is a plan view of the strainer 65, FIG. 16 is a view as seen from an arrow XVI in FIG. 15, and FIG. 17 is a view as seen from an arrow XVII in FIG. 15. The strainer 65 is formed in a quarter divided dome shape as shown in FIGS. 16 and 17, and is provided with a mounting flange 65*a* in an upper end, and the mounting flange 65*a* is fixed on the upper end faces of the peripheral wall 61 by the presser plate 66 shown in FIG. 14.

[Oil Pump and Scavenging Oil Pump]

Figure 23:
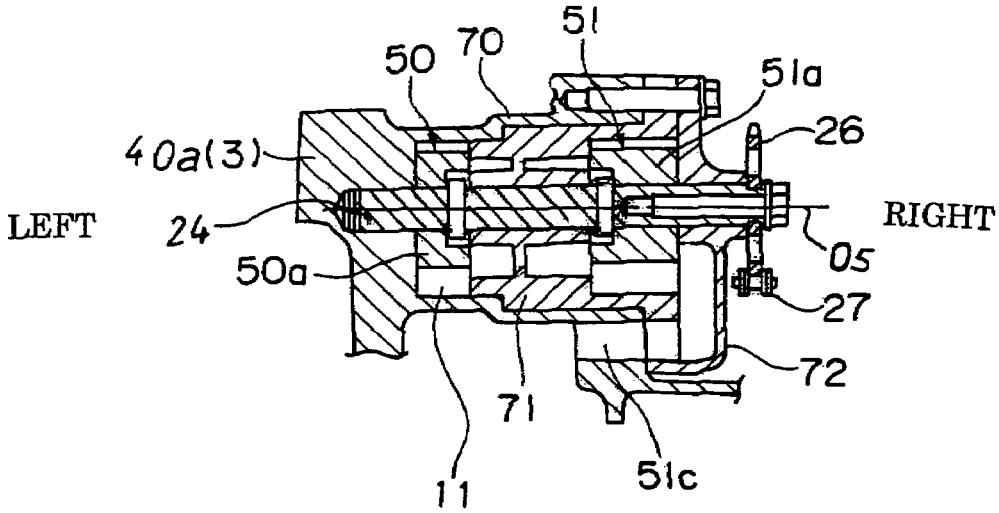
FIG. 23 is a cross sectional view of an oil pump and a scavenging oil pump in FIG. 1 along a line XXIII-XXIII.

FIG. 23 is a cross sectional view along a line XXIII-XXIII in FIG. 1), and shows a cross sectional view of the feed oil pump 50 for feeding the oil, and the scavenging oil pump 51 for recovering the oil. Both of the oil pumps 50 and 51 are trochoid pumps. A casing of the scavenging oil pump 51 is structured in a right side and a casing of the feed oil pump 50 is structured in a left side, by forming a tubular outer casing portion 70 in a lower end portion of the partition wall 40*a* of the lower crankcase member 3, fitting an intermediate casing member 71 into the outer casing portion 70, and closing a right opening end of the intermediate casing member 71 by a pump cover 72.

Inner rotors 50*a* and 61*a* arranged in the casings of the pumps 50 and 51 are firmly attached to the common pump shaft 24. As mentioned before, in FIG. 1, the rotation power of the input shaft 14 is transmitted to the common pump shaft 24 via the drive sprocket 25, the chain 27 and the driven sprocket 26.

In FIG. 19, the suction portion 51*b* of the scavenging oil pump 51 is downward opened toward an inner side of the oil pan 23, and is communicated in a liquid tight manner with an upper end of the collection oil suction passage 69 mentioned above, and a discharge portion 51*c* is opened to the lower portion (the oil reservoir portion) of the transmission room 11. In other words, the scavenging oil pump 51 is structured such as to suck the oil in the oil collecting chamber 60 from the suction portion 51*b* via the collection oil suction passage 69, and discharge the oil to the transmission room 11 from the discharge portion 51*c*.

[Oil Supply Path from Oil Pump to Main Gallery]

Figure 7:
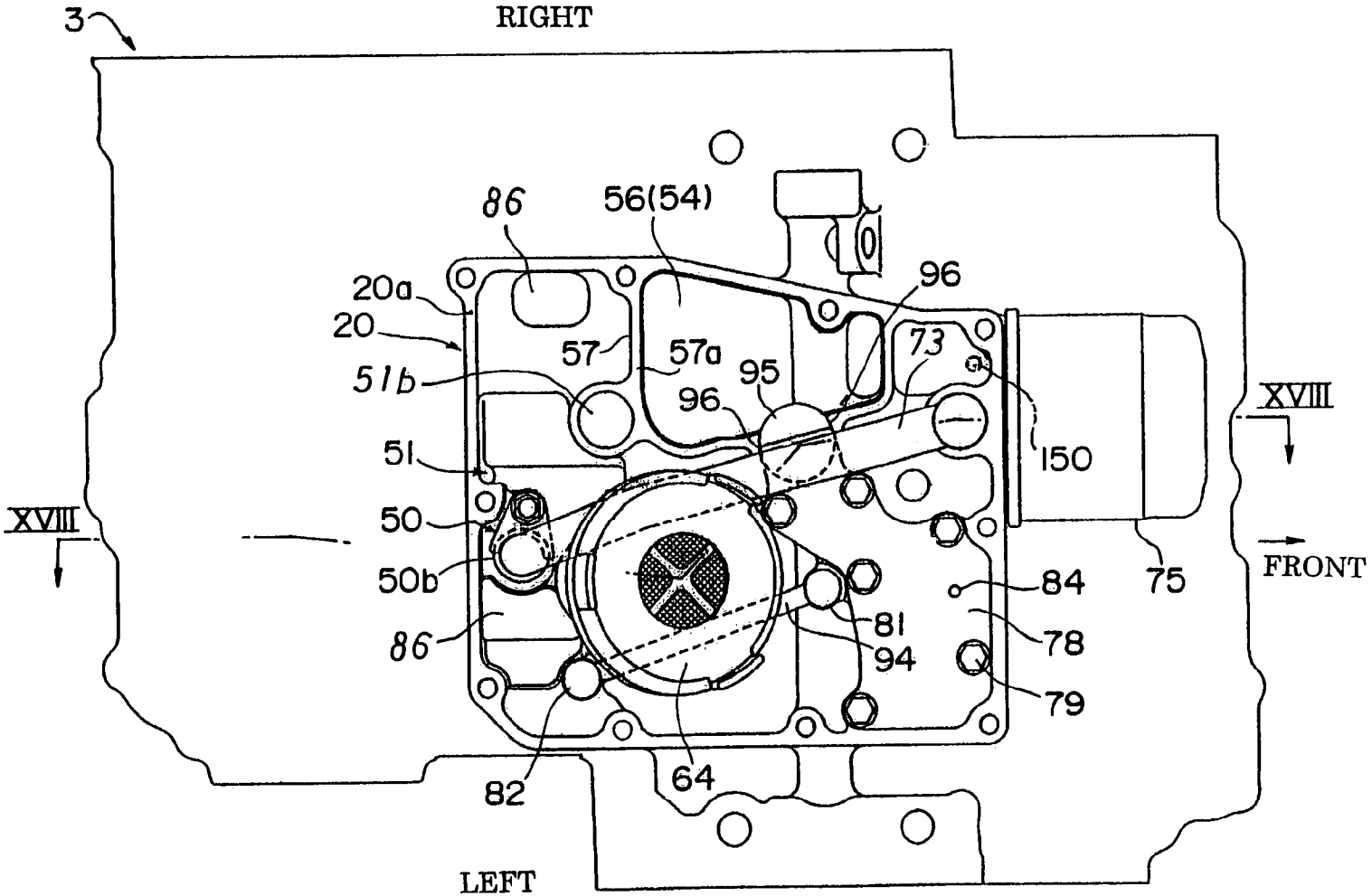
FIG. 7 is a bottom view of the lower crankcase member in FIG. 1, and a bottom view showing a state in which the oil pan is detached.
Figure 18:
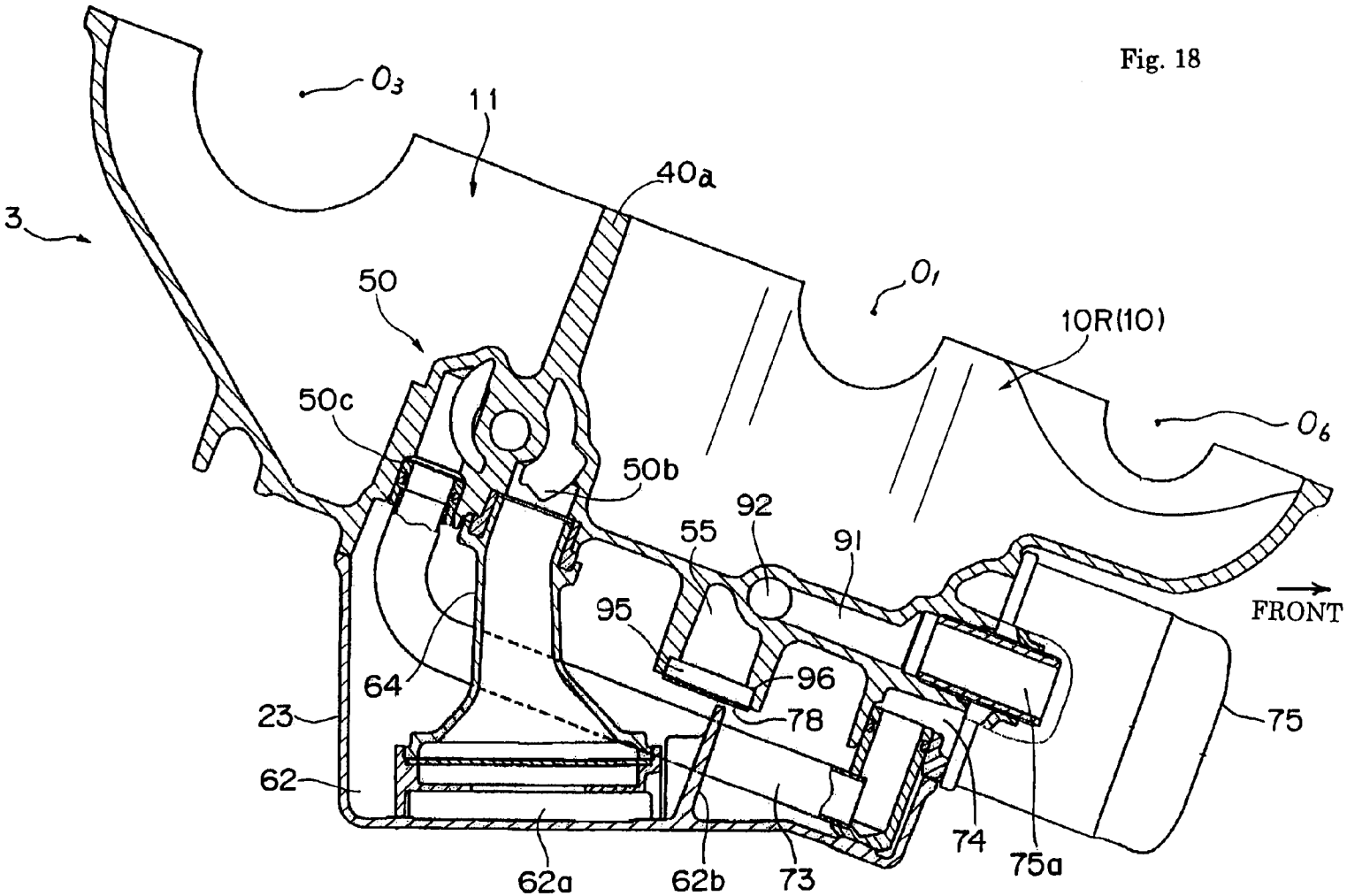
FIG. 18 is a cross sectional view of the lower crankcase member in FIG. 5 along a line XVIII-XVIII.

FIG. 18 is a cross sectional view along a line XVIII-XVIII in FIG. 5 (a cross sectional view along a line XVIII-XVIII in FIG. 7). A suction portion 50*b* and a discharge portion 50*c* of the feed oil pump 50 are open downward toward the oil suction chamber 62 within the oil pan 23 from the bottom wall of the lower crankcase member 3, and an upper end portion of the funnel-shaped strainer (primary filter) 64 is connected to the suction portion 50*b*, thereby sucking the oil within the oil suction chamber 62. A C-shaped oil supply pipe 73 extending forward within the oil pan mounting portion 20 and within the oil pan 23 is connected to the discharge portion 50*c*, and a front end portion of the oil supply pipe 73 is connected to an oil supply passage 74 formed in a front end portion of the oil pan mounting portion 20. The oil supply passage 74 is communicated with an unpurified side of the of an oil filter (a secondary filter) 75 firmly attached to the front end surface of the oil pan mounting portion 20, a purified side outlet 75*a* of the oil filter 75 is communicated with an oil supply passage 91 formed in the bottom wall of the lower crankcase member 3 and extending to a rear side, and the oil supply passage 91 is communicated with a main gallery 92 formed in the bottom wall of the lower crankcase member 3. In other words, the structure is made such that the oil discharged from the feed oil pump 50 is supplied to the main gallery 92 within the bottom wall of the crank case 1 through the oil supply pipe 73 within the oil pan 23, the oil supply passage 74, the oil filter 75 and the oil supply passage 91.

[Shape within Oil Pan Mounting Portion]

Figure 6:
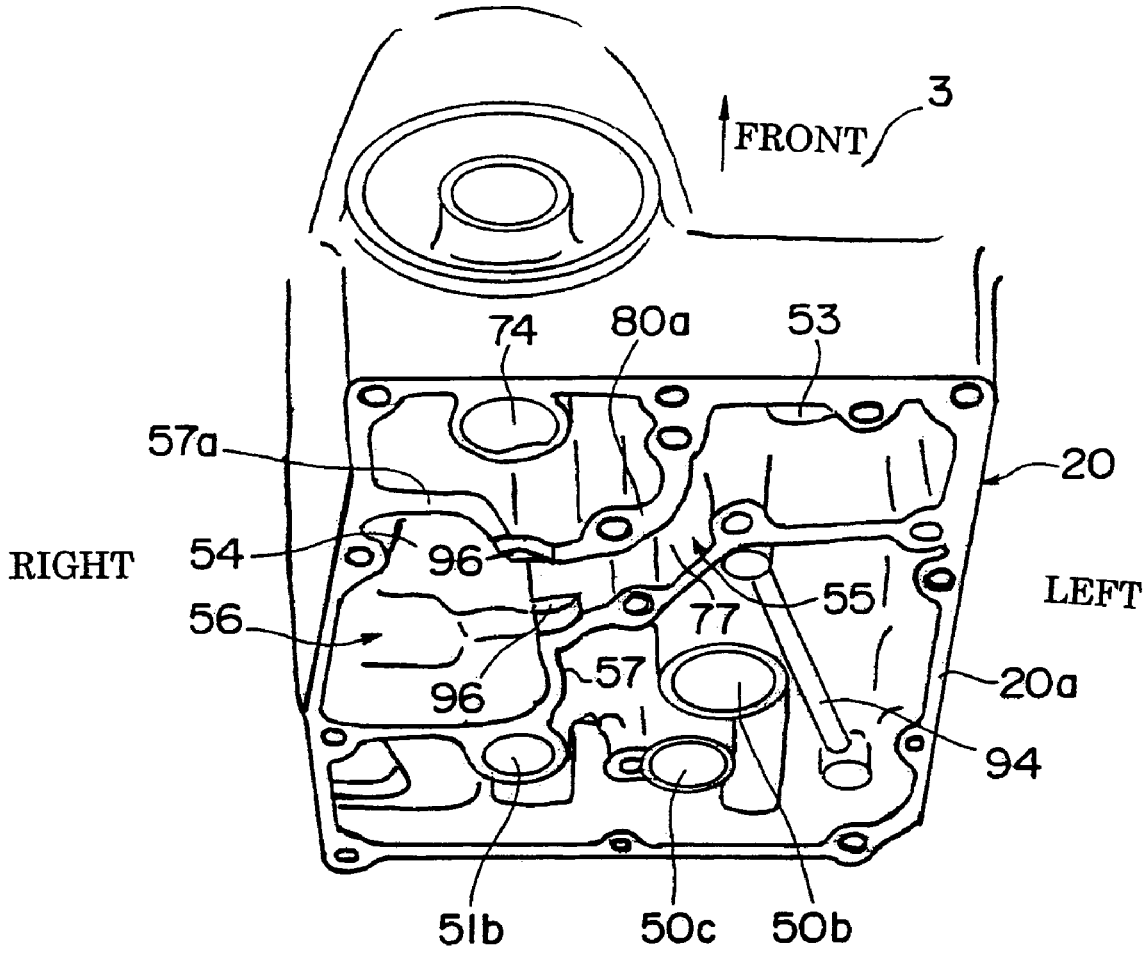
FIG. 6 is a perspective view in the case of viewing a oil pan mounting portion for an oil pan of the lower crankcase member in FIG. 1 from a front lower side.
Figure 8:
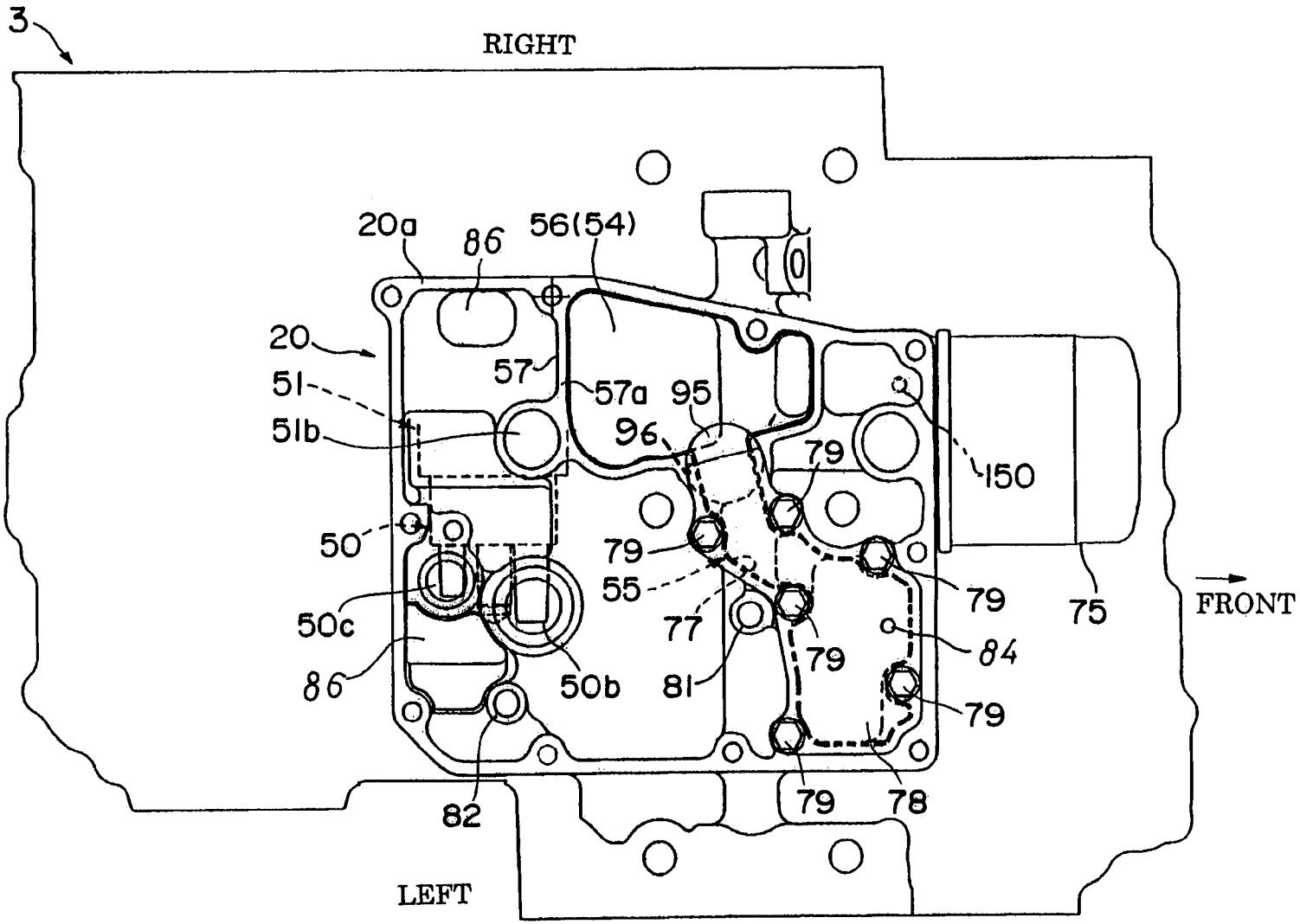
FIG. 8 is a bottom view of the lower crankcase member in FIG. 1, and showing a state in which the oil pan and a piping within the oil pan mounting portion are detached.
Figure 9:
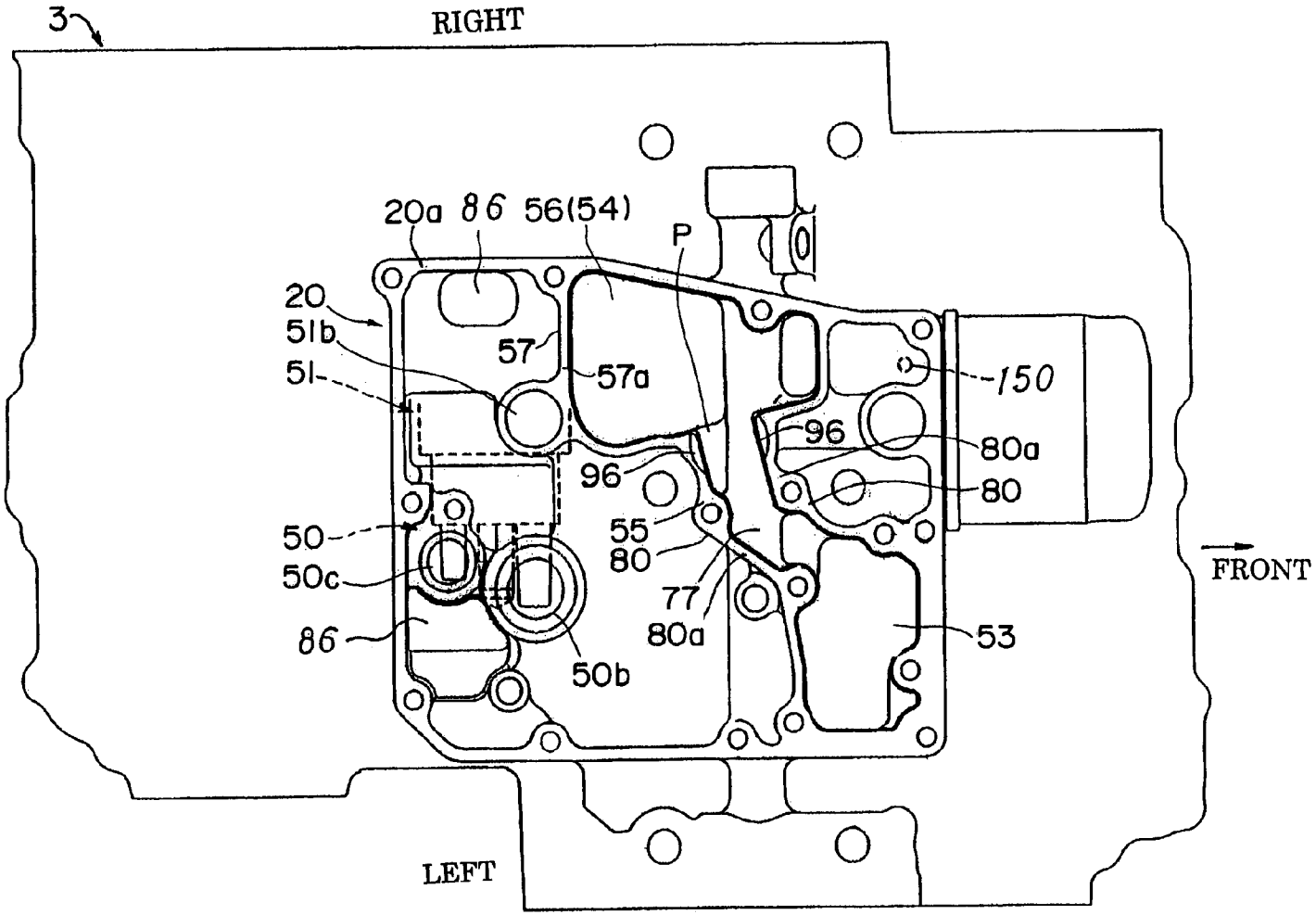
FIG. 9 is a bottom view of the lower crankcase member in FIG. 1, and a bottom view showing a state in which the oil pan, the piping within the oil pan mounting portion for the oil pan and a bottom plate are detached.

FIGS. 6 to 9 show the oil pan mounting portion 20 in the lower surface of the lower crankcase member 3, FIG. 6 is a perspective view as seen from a front lower side, FIG. 7 is a bottom view of the crank case 1 showing a state in which various oil piping parts are installed, FIG. 8 is a bottom view of the crank case 1 showing a state in which all the piping parts are deleted and a bottom plate 78 for forming the oil collecting passage is remained with respect to FIG. 7, and FIG. 9 is a bottom view showing a state in which the bottom plate is deleted with respect to FIG. 8.

In FIG. 8, within the oil pan mounting portion 20 of the lower crank case member 3, as mentioned above, the suction portion 50*b* of the feed oil pump 50, the discharge portion 50*c* of the feed oil pump 50 and the suction portion 51*b* of the scavenging oil pump 51 are formed in the rear portion, the space portion 56 is formed in the right end portion, and the oil collecting passage 55 is formed from the left front end portion to the space portion 56. In addition thereto, there are formed a pair of front and rear connection ports 81 and 82 for connecting the oil supply pipe 94 for lubricating the transmission, and the oil supply pipe 94 is attached between both the connection ports 81 and 82 as shown in FIG. 7.

[Structure of Oil Collecting Passage]

Figure 20:
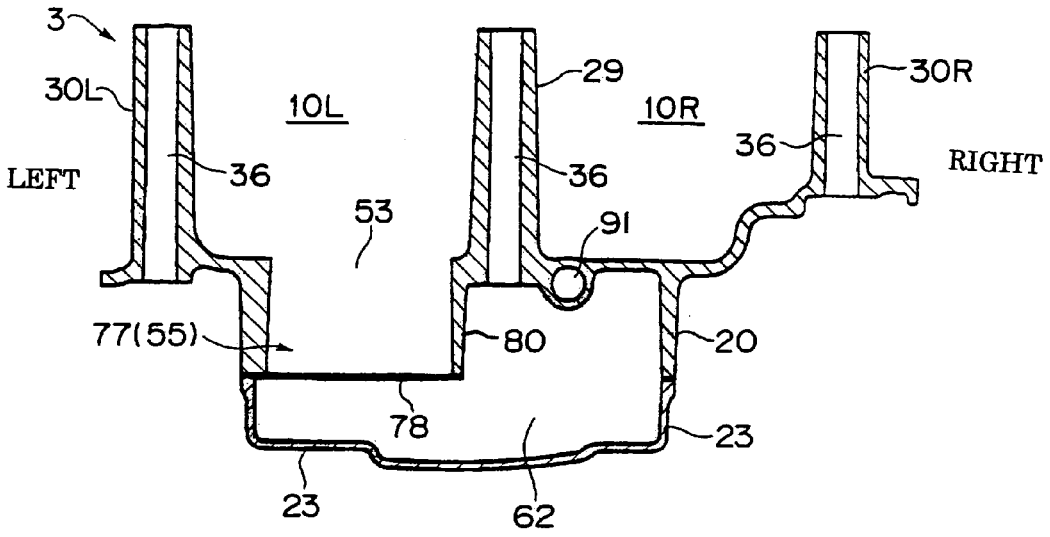
FIG. 20 is a cross sectional view of the lower crankcase member in FIG. 5 along a line XX-XX.

In FIG. 8, the oil collecting passage 55 is constituted by a passage forming groove 77 and the bottom plate 78. The passage forming groove 77 is formed in a lower surface of the bottom wall (the bottom walls of the individual crank chambers 10L and 10R shown in FIG. 3) in the lower crankcase member 3 so as to open the lower end. The bottom plate 78 is made of a sheet metal and fastened to a lower end surface of the passage forming groove 77 by a bolt 79. Thereby, an inner side of the oil collecting passage 55 is isolated in a liquid tight manner from the oil suction chamber 62 within the oil pan 23 by the bottom plate 78, as shown in FIG. 20 corresponding to a cross section along a line XX-XX in FIG. 5.

In FIG. 9, a lower end surface 80*a* of a side wall 80 of the passage forming groove 77 is formed within the same surface as the oil pan mounting face 20*a* together with the lower end mounting face 57*a* of the peripheral wall 57 of the oil collecting chamber communicating space portion 56 and the lower end surface of the oil suction port 51*b* of the scavenging oil pump 51.

Figure 11:
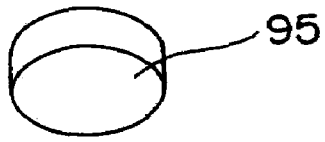
FIG. 11 is a perspective view of a mounting face supplement member.

A position P intersecting the passage forming groove 77 in the lower end mounting face 57*a* of the peripheral wall 57 of the oil collecting chamber communicating space portion 56 is open so as to allow a casting process. In order to supplement a sealing performance at the open position P, a pair of circular arc step portions are formed as a mounting face supplement member supporting seat 96 in the lower end surface 80*a* of the side wall 80 of the passage forming groove 77 near the open position P. As shown in FIG. 8, a mounting face supplement member 95 is fitted to the supporting seat 96, and is fixed by the bottom plate 78 from a lower side. A mounting face (a seal surface) having no cut line is completed in the periphery of the space portion 56 by the mounting face 57*a* formed in the peripheral wall 57 and the mounting face supplement member 95. The mounting face supplement member 95 is formed in a disc shape as shown in FIG. 11.

In FIG. 7, in a state in which the mounting face supplement member 95 is fitted to the supporting seat 96, the lower end mounting face of the mounting face supplement member 95 forms approximately the same surface as the oil pan mounting face 20*a* and the lower end mounting face 57*a* of the peripheral wall 57 of the space portion 56. Accordingly, as shown in FIG. 19 and FIG. 22 corresponding to the cross section along a line XXII-XXII in FIG. 5, the gasket 58 arranged in an entire region of the mating face 61*a* of the peripheral wall 61 of the oil collecting chamber 60 are pressed all over against the upper end surface of the oil pan 23 by the oil pan mounting face 20*a*, the lower end mounting face 57*a* of the peripheral wall 57 of the space portion 56 and the lower end surface 95*a* of the mounting face supplement member 95 in FIG. 21, and the gasket 58 can seal the mounting faces 20*a*, 57*a* and the surface 95*a*.

Figure 10:
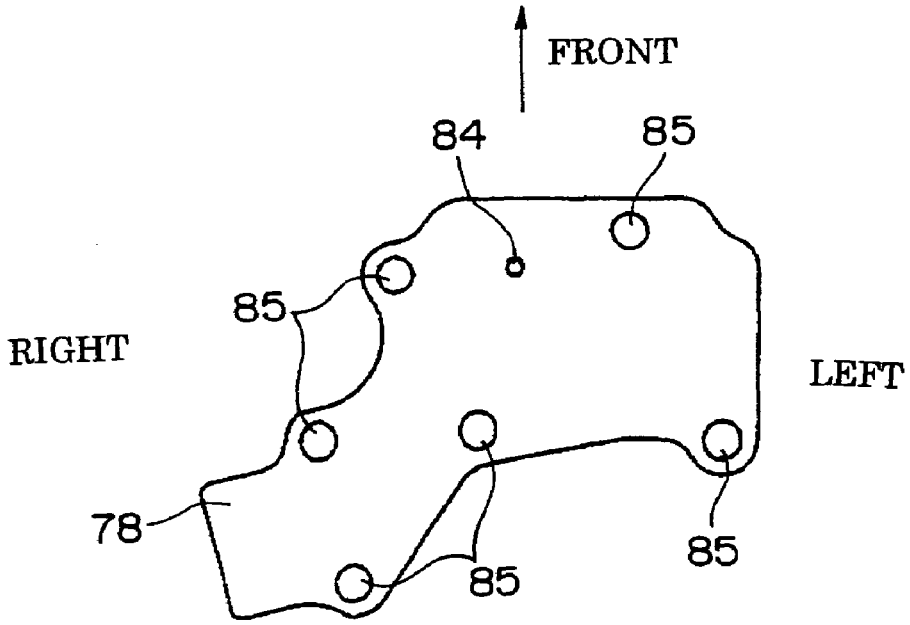
FIG. 10 is a bottom view of the bottom plate.

FIG. 10 is a bottom view of the bottom plate 78 mentioned above. In the bottom plate 78, a plurality of bolt insertion holes 85 are formed in a peripheral portion, and a regulating hole 84 having a small diameter for equalizing oil level is formed near a front end portion. Since the regulating hole 84 communicates between the inner side of the oil collecting passage 55 in FIG. 20 and the inner side of the oil suction chamber 62 of the oil pan 23 in FIG. 20, the oil in the oil reservoir portion such as the transmission room 11 or the like in FIGS. 3 and 4 moves into the crank chamber 10 side step by step when the engine stops, thereby the oil level within the transmission room 11 and the oil level within the crank chamber 10 are equalized. However, since the regulating hole 84 has a small diameter, during the engine operation, it hardly affects the oil flow to the oil collecting chamber 60 only by discharging just a part of the recovered oil flowing within the oil collecting passage 55 to the oil suction chamber 62.

[Oil Reservoir Portion and Oil Inspection Window]

As mentioned above, the oil reservoir portion of the semidry sump type lubricating system comprises the lower portion of the transmission room 11 shown in FIGS. 3 and 4, the lower portion of the clutch room 12 communicating with the lower portion of the transmission room 11 via the communication hole 42, and the oil suction chamber 62 of the oil pan 23 in FIG. 12 communicating with the transmission room 11 via a communication hole 86 (FIG. 3).

Figure 2:
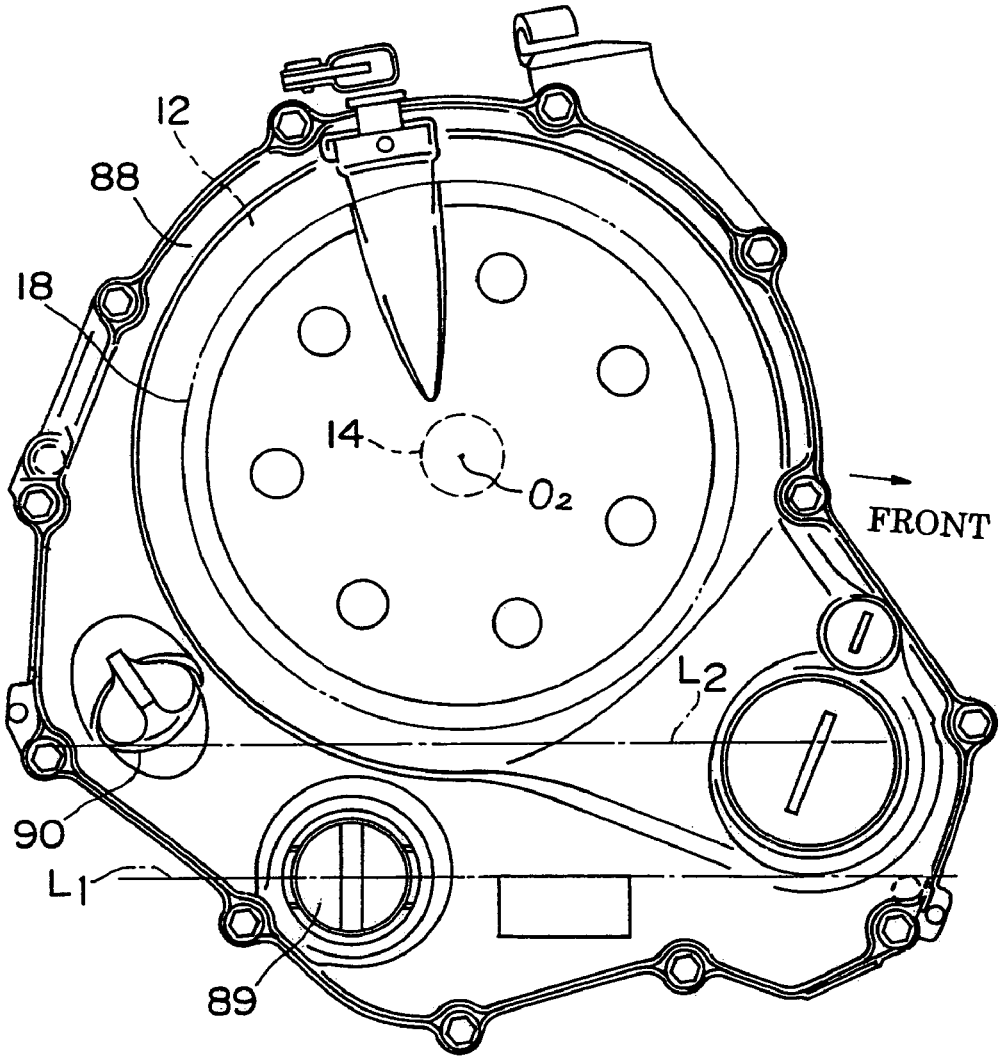
FIG. 2 is a right side view of the clutch cover of the engine shown in FIG. 1.

FIG. 2 is a right view of the clutch cover 88 covering the right opening portion of the clutch room 12. A transparent oil inspection window 89 is provided in a lower portion of the clutch cover 88, and is structured such as to inspect the oil level within the clutch room 12 from the outside. The oil inspection window 89 is preferably positioned at such a height that an oil level L1 within the clutch room 12 can be viewed from the outside while the engine is kept stopping. Namely, after the engine stops, the oil within the oil reservoir portion including the inner side of the clutch room 12 flows into the crank chamber 10 in FIG. 3 or the like via the regulating hole 84 of the bottom plate 78 in FIG. 7, and, as a result, the oil levels within the oil reservoir the oil levels within the oil reservoir portion and the crank chamber 10 are equalized into the oil level L1.

On the other hand, an oil level L2 during the engine operation shown in FIG. 2 becomes higher than the oil level L1 during the engine stop because the oil within the crank chamber 10 (FIG. 3 or the like) is forcibly pumped out to the oil reservoir portion by the scavenging oil pump 51. The oil level L2 becomes, for example, a height corresponding to a height of the partition wall 40*b* (FIG. 3 or the like) between the clutch room 12 and the crank chamber 10. With respect to the oil level L2 during the engine operation, a multi-disc friction clutch 18 installed to the input shaft 14 and a ring gear provided in a clutch housing of the clutch 18 are arranged at a higher position than the oil level L2 where they are not dipped into the oil. In other words, it is possible to make the position of the clutch 18 higher by making the position of the input shaft 14 higher, and a power loss is not generated due to an oil agitation or stir during the engine operation.

[Oil Supply Path from Main Gallery to Crank Shaft Lubricating Position]

Figure 21:
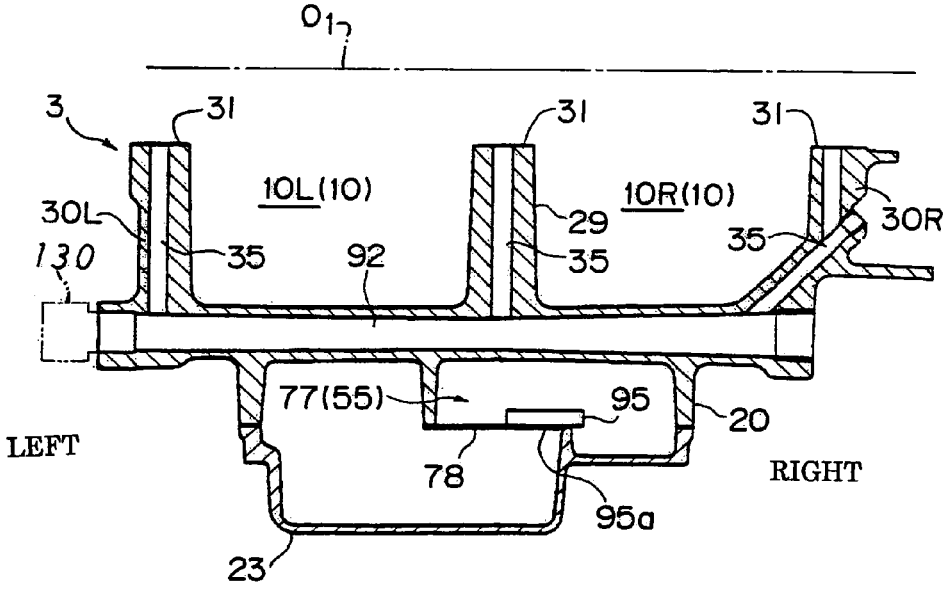
FIG. 21 is a cross sectional view of the lower crankcase member in FIG. 5 along a line XXI-XXI.
Figure 22:
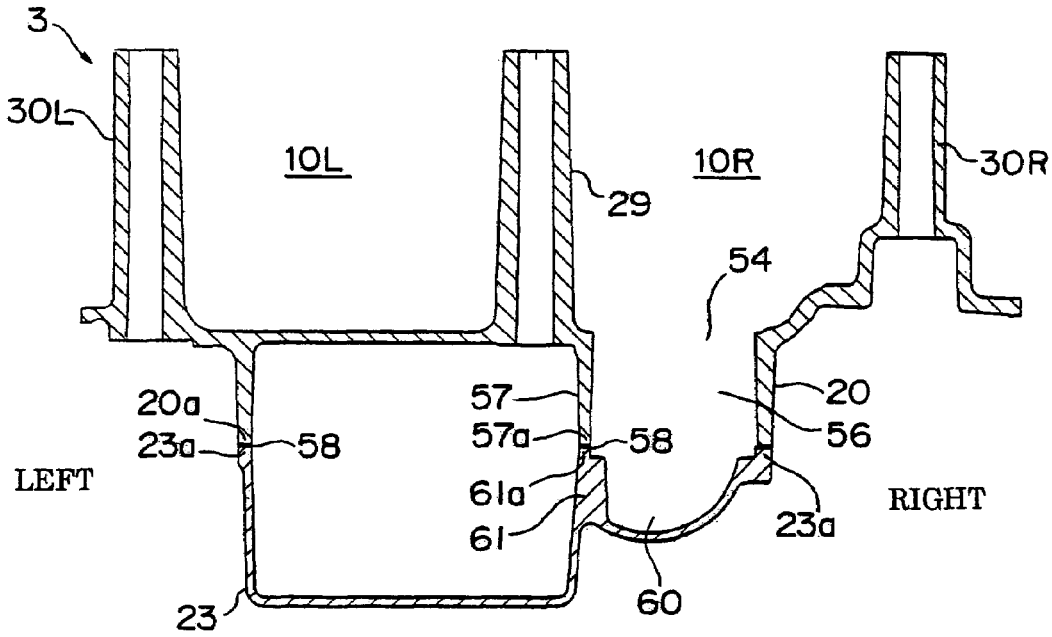
FIG. 22 is a cross sectional view of the lower crankcase member in FIG. 5 along a line XXII-XXII.

FIG. 21 is a cross section along a line XXI-XXI in FIG. 5. The main gallery 92 formed in the bottom wall of the lower crank case member 3 is positioned approximately just below the crank shaft center O1, extends in a lateral direction, is communicated with the lower end of the oil supply holes 35 formed in the left and right side walls 30L and 30R and the intermediate partition wall 29 of the crank chamber 10, and is structured such as to supply the oil to each of the bearing concave portions 31 for supporting the crank shaft. Further, an oil supply pipe 130 (shown by the two dotted line) for lubricating the balancer shaft is connected to a left end portion of the main gallery 92.

[Oil Supply Path from Main Gallery to Transmission Lubricating Position]

Figure 24:
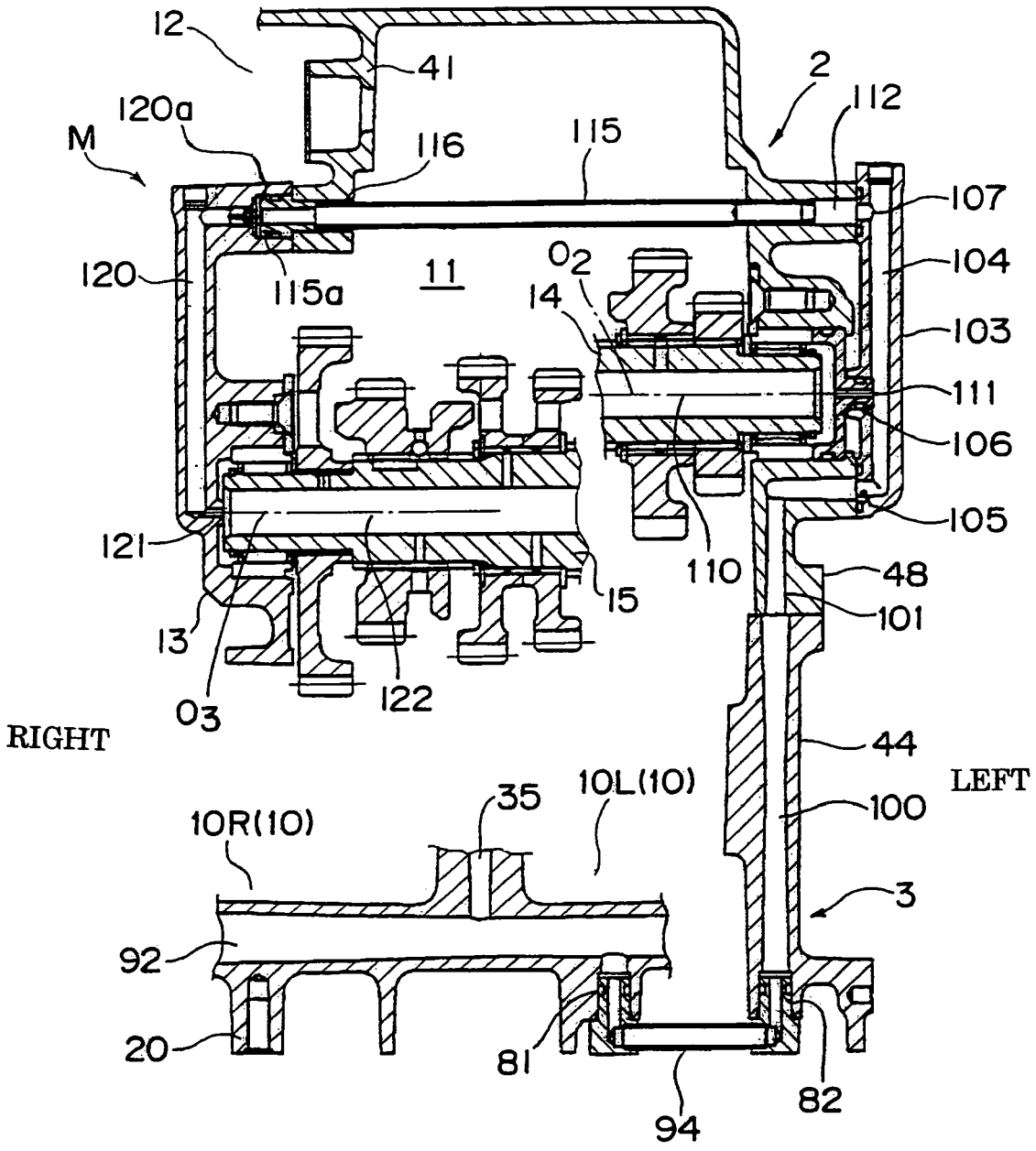
FIG. 24 is a view showing a cross section of a cassette type transmission as seen from a front side.

FIG. 24 shows an oil supply path for lubricating the transmission. Since FIG. 24 is a cross sectional view as seen from a front side, a lateral direction in the drawing is inversed to an actual lateral direction. An oil supply passage 100 extending to an upper side from the connection port 82 is formed in a left side wall 44 of the transmission room 11 of the lower crank case member 3. The connection port 82 is communicated with the main gallery 92 via the oil supply pipe 94, as mentioned above. An oil supply passage 101 for lubricating the transmission is formed in a left side wall 48 of the transmission room 11 of the upper crank case member 2. The oil supply passage 101 is communicated with an upper end of the oil supply passage 100 in the lower crank case member 3. The oil supply passage 101 extends upward and is open toward a left side (an outer side of the crank case) at a position near the input shaft 14. An oil passage forming body 103 which is independent from the upper crank case member 2 is detachably fixed to an outer side surface of the left side wall 48 of the transmission room 11 of the upper crank case 2, the oil passage forming body 103 has an oil supply passage 104 extending upward therein, and has an oil inlet 105, a first oil output port 106 and a second oil output port 107. The oil inlet 105 is communicated with an upper end opening of the upper end oil supply passage 101 of the upper crankcase member 2. The first oil output port 106 is positioned on an extension of the shaft center O2 of the input shaft 14 and communicated with an oil hole 110 of the input shaft 14 via a throttle 111. The second oil output port 107 opens at an upper position of the input shaft 14. The oil inlet 105 and both the oil output ports 106 and 107 open toward a right side.

The second oil output port 107 is communicated with an oil hole 112 formed in the left side wall 48 of the transmission room 11 of the upper crankcase member 2. An oil communication pipe 115 is pressure inserted and fixed to the oil hole 112. The oil communication pipe 115 extends to a right side, and passes through a penetrating hole 116 of the transmission assembly mounting wall 41 of the upper crank case member 2. The joint portion with seal 115*a* in a right end portion of the oil communication pipe 115 protrudes into the clutch room 12.

An upper end connection port 120*a* of an oil supply passage 120 for lubricating the transmission, formed within the shaft support member 13 of the transmission assembly M, is detachably fitted to the joint portion with seal 115*a*, and can be inserted and drawn in a lateral direction (in parallel to an axial direction of the crank shaft). The oil supply passage 120 within the shaft support member 13 extends to a lower side, and a lower end portion thereof is communicated with an oil hole 122 of the output shaft 15 via a throttle 121.

FIG. 25 is a left side view of the crank case 1, and the oil passage forming body 103 is detachably mounted to the left side wall of the upper crank case member 2 by a bolt 125. Further, the oil communication pipe 130 for lubricating the balancer shaft 8 extends from the main gallery 92, to a front side, is connected to an oil supply passage 131 at a position near the balancer shaft 8, and is structured such as to supply the oil to the bearing portion of the balancer shaft 8.

[Flow of Oil in Entire of Engine]

Figure 26:
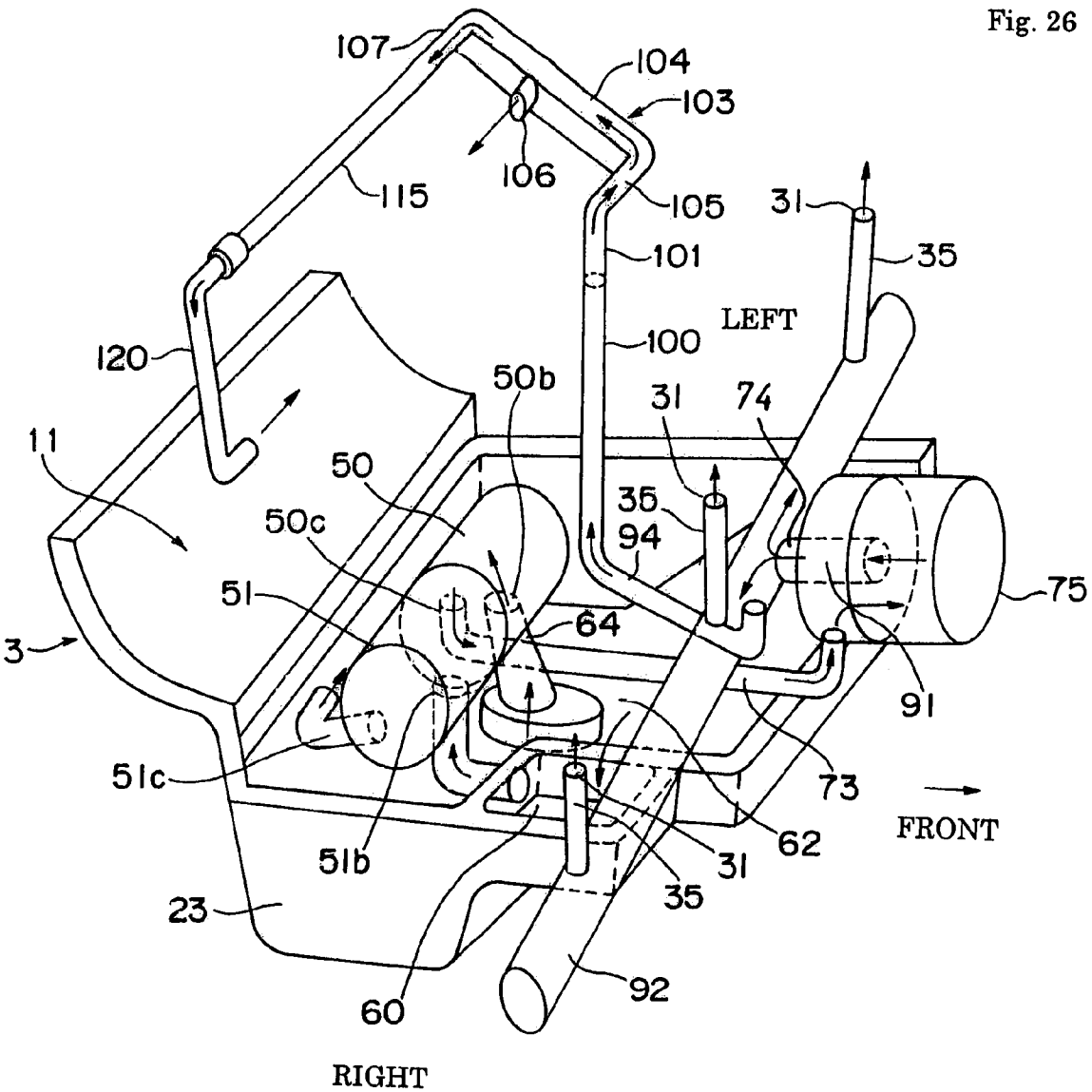
FIG. 26 is a perspective schematic view of piping showing a flow of oil in the engine.

FIG. 26 is a schematic view obtained by simply arranging the flow of the oil in the entire of the engine. The oil in the oil reservoir portion constituted by the transmission room 11 or the like is sucked from the oil suction chamber 62 within the oil pan 23 via the strainer (the primary filter) 64 by the feed oil pump 50, is pressurized, is pressure fed forward from the discharge portion 50*c* via the oil supply pipe 73, enters into the oil filter (the secondary filter) 75 in the front end of the oil pan mounting portion 20 for the oil pan 23, is purified and is thereafter pressure fed to the main gallery 92 via the oil supply passage 74.

A part of the oil pressure fed to the main gallery 92 is divided into three oil supply holes 35 for lubricating the crank shaft 7 (FIG. 1), and lubricates each of the journal portions of the crank shaft 7.

Further, in FIG. 26, a part of the oil within the main gallery 92 is supplied to the oil supply passage 104 in the oil passage forming body 103 via the oil supply pipe 94, the oil supply passage 100 in the lower crankcase member 3 and the oil supply passage 101 in the upper crankcase member 2. A part of the oil within the oil supply passage 104 is supplied to the oil hole 110 in FIG. 24 in the input shaft 14 via the first oil output port 106 and the throttle 111, and the rest is supplied from the second oil output port 107 to the oil hole 122 of the output shaft 15 via the oil communication pipe 115, the oil supply passage 120 within the transmission assembly support member 13 and the throttle 121.

As shown in FIG. 24, the oil supplied to each of the oil holes 110 and 122 in the input shaft 14 and the output shaft 15 is supplied to the fitting portion of the speed change gear, and lubricates the fitting portion of the speed change gear, and the oil after being utilized for lubricating the transmission is directly returned to the oil reservoir portion in the lower portion of the transmission room 11.

Meanwhile, the oils utilized for lubricating the crank shaft from the oil supply hole 35 in FIGS. 3 and 4 come back to the respective bottom surfaces of the left and right individual crank chambers 10L and 10R, and are independently discharged respectively from the oil drain ports 53 and 54. As shown in FIG. 19, the oil discharged from the oil drain port 54 of the right individual crank chamber 10R passes through the space portion 56 and, is discharged to the oil collecting chamber 60, positioned just below the space portion 56, and is filtered by the strainer 65. In FIG. 5, the oil discharged from the oil drain port 53 of the left crank chamber 10L reaches the space portion 56 through the oil collecting passage 55, is discharged to the inner side of the oil collecting chamber 60 in FIG. 19 from the space portion 56 together with the oil from the right crank chamber 10R, and is strained.

The oil filtered by the strainer 65 in the oil collecting chamber 60 is sucked up by the scavenging oil pump 51 via the collection oil suction passage 69, and is discharged to the lower portion (the oil reservoir portion) of the transmission room 11.

[Change of Oil Level]

Since the oil within the crank chamber 10 is always discharged forcibly by the scavenging oil pump 51 during the engine operation, the inner side of the crank chamber 10 is kept in a dry state. On the other hand, within the oil reservoir portion, the oil level ascends to a level near an upper end of the partition wall 40*b* (FIG. 3) in the front end portion of the clutch room 12, as shown by the level L2 in FIG. 1. Since the input shaft 14 is arranged so high position that the housing of the clutch 18 and the ring gear installed to the end portion of the input shaft 14 are not dipped into the oil of the oil level L2 during the engine operation as mentioned above, the agitating or stir resistance is not generated.

Further, in FIG. 5 and FIG. 7, when the oil in the left individual crank chamber 10L passes through the oil collecting passage 55 during the engine operation, a part of the flowing oil within the oil collecting passage 55 may leak to the oil suction chamber 62 via the regulating hole 84 of the bottom plate 78 in FIG. 7. However, since the regulating hole 84 has a small diameter, the leaking amount is very small in comparison with the entire oil amount flowing within the oil collecting passage 55, and the leak hardly affects an oil collection operation.

In the case of stopping the operation, and just after the stop, the oil level in the oil collection portion is the same oil level L2 as that during the engine operation, and the inner side of the crank chamber 10 is in a dry state. However, in accordance with a time elapse, the oil comes back to the crank chamber 10 from the various lubricated positions such as the bearing of the crank shaft 7, the bearing of the cam shaft, the piston and the like step by step, and the oil in the oil reservoir portion moves to the crank chamber 10 via the regulating hole 84 of the bottom plate 78 of the oil collecting passage 55, whereby the oil within the reservoir portion and the oil within the crank chamber 10 become approximately the same level as shown by the oil level L1 in FIG. 1. It is possible to check out the oil amount of the entire of the engine by inspecting the equalized oil level from the oil inspection window 89 of the clutch cover 88 in FIG. 2.

In other words, it is possible to easily check out the oil remaining amount in the entire of the engine, by inspecting the oil level at one position within the oil reservoir portion.

In this connection, in the case that the regulating hole 84 is not formed, the oil level is not equalized even during the engine stop, the oil amount in the oil reservoir portion can be only checked out by the oil inspection window 89 provided at one position of the clutch cover 88, and it is impossible to check out the oil amount within the crank chamber 10. Therefore, it is hard to accurately check out the remaining oil amount in the entire of the engine.

EFFECT OF EMBODIMENT IN ACCORDANCE WITH PRESENT INVENTION (1) In the semidry sump type in-line two-cylinder engine, since the oil drain ports 53 and 54 are formed respectively in the bottom surfaces of the left and right individual crank chambers 10L and 10R, and the oil is independently discharged in each of the individual crank chambers 10L and 10R, it is possible to quickly discharge the oil from each of the individual crank chambers 10L and 10R, it is possible to well keep each of the individual crank chambers 10L and 10R in the dry state during the engine operation, and it is possible to effectively prevent the power loss due to the agitation of the oil or the like.

(2) Since the structure is made such as to combine the oil discharged from one, for example, the left individual crank chamber 10L with the oil discharged from the right individual crank chamber 10R on the basis of the oil collecting passage 55 formed in the bottom wall of the crank case 1 so as to discharge to the oil collecting chamber 60, it is possible to prevent the conventional matter that the oil from the crank chamber having no oil drain port flows into the crank chamber having the oil discharge hole via the small communication hole in the partition wall, whereby a smoothness of the oil circulation is obstructed and the dry state is obstructed.

(3) Since the oil collecting passage 55 is constituted by the lower end open shaped passage forming groove 77 formed in the bottom wall of the lower crankcase member 3 and the metal sheet bottom plate 78 closing the lower end of the passage forming groove 77, no specific piping for recovering the oil is necessary, and it is possible to easily form the oil collecting passage 55 on the basis of a casting and a sheet metal process of the bottom plate 78.

(4) Since the strainer 65 is arranged in the oil collecting chamber 60 within the oil pan 23, it is possible to effectively utilize the limited space of the oil pan 23, and it is possible to collectively filter the oil recovered from each of the individual crank chambers 10L and 10R so as to be recovered in the oil collection portion.

(5) Since the oil piping space is formed within the oil pan mounting portion 20 for the oil pan 23, the oil collecting passage 55 is formed within the oil piping space, and the oil supply pipe 73 and the oil supply pipe 94 for lubricating the transmission are arranged within the oil piping space, it is possible to effectively utilize the space within the oil pan mounting portion 20 for the oil pan 23. Further, even if the oil leakage is generated at the joint position of the piping, the oil leaks into the oil pan 23 and does not leak to the external portion.

(6) Since the semidry sump type is structured by forming the partition wall 40*a* between the clunk chamber 10 and the transmission room 11, and setting the lower portion of the transmission room 11 as the oil reservoir portion, no independent oil tank is necessary, and the cost and the space for the tank are not necessary. In addition thereto, since the partition wall 40*b* is formed between the crank chamber 10 and the clutch room 12, and the lower portion of the clutch room 12 is formed as the constituting element of the oil reservoir portion, it is possible to increase the oil accommodating mount.

(7) Since the small-diameter regulating hole 84 communicating the transmission room 11 side with the crank chamber 10 side (within the oil collecting passage 55) is formed in the bottom plate 78 of the oil collecting passage 55, the oil within the oil reservoir portion constituted by the transmission room 11, the clutch room 12 and the oil suction chamber 62, and the oil within the crank chamber 10 are equalized after a fixed time elapse from the engine stop so as to becomes approximately the same oil level L1. Accordingly, it is possible to check out the oil remaining amount of the entire within the engine, for example, only by forming one level inspection window 89 which can inspect only the oil level within the clutch room 12, in the clutch cover 88.

(8) Since the regulating hole 84 for equalize the oil level is formed at the lower position near the bottom wall of the oil pan 23, it is possible to quickly equalize the oil level while sufficiently utilize the heat pressure.

(9) Since the regulating hole 84 is formed in the bottom plate 78 made of the sheet plate, the work of the regulating hole 84 is easily executed, for example, in comparison with the case that it is formed in the crank case 1.

OTHER EMBODIMENTS (1) It is possible to apply the present invention to an in-line multi-cylinder engine having three or more cylinders.

(2) The regulating hole for equalizing the oil levels may be formed in the bottom wall of the crank case 1. For example, as shown by a virtual line in FIGS. 7 to 9, it is possible to form a regulating hole 150 near the front end portion of the mounting portion 20 for the oil pan 23.

(3) The embodiment mentioned above relates to the semidry sump type lubricating system in which the transmission room is utilized as the oil reservoir portion. However, it is possible to employ a dry sump type lubricating system in which an independent oil tank is installed in the outer portion of the crank case.

(4) In the embodiment mentioned above, the structure is made such that the oil collecting chamber 60 is arranged in the lower side than the bottom wall of one individual crank chamber 10R, the oil in the individual crank chamber 10R is directly discharged to the oil collecting chamber 60, and the oil in the other individual crank chamber 10L is discharged to the oil collecting chamber 60 via the oil collecting passage 55. However, the structure may be made such that the oil collecting chamber 60 is formed such wide as to reach the left and right oil drain ports 53 and 54, and the oil collecting passage does not absolutely exist.

(5) The oil pan 23 in accordance with the embodiment mentioned above is formed as the container shape having the fixed volumetric capacity. However, it is possible to apply to a structure of the oil pan in which a flat-shaped member nearly functioning only as the bottom plate is attached to the oil pan mounting portion for the oil pan.

(6) The diameter of the regulating hole 84 (150) is set to 5 mm to 7 mm in the embodiment mentioned above. However, the present invention is not limited to this numerical range, but can appropriately select various diameters as far as the amount of the oil flowing to the oil collecting chamber side from the oil reservoir portion side through the regulating hole is smaller than the amount of the oil pumped out to the oil reservoir portion side from the oil collecting chamber side by the scavenging oil pump.

Although the invention has been described in its preferred embodiments with a certain degree of particularity, obviously many changes and variations are possible therein. It is therefore to be understood that the present invention may be practical otherwise than as specifically described herein without departing from the scope and spirit thereof.

What is claimed is:

1. A lubricating system of an engine in which plural cylinders are provided so as to be arranged in a direction of a crank shaft, an oil pan is mounted to an oil pan mounting portion formed in a lower surface of a crank case, and a whole of a crank chamber in the crank case is partitioned into plural individual crank chambers by a partition wall so as to correspond to the cylinders in which the crank chamber has a bottom wall to isolate the crank chamber from the oil pan, comprising:

an oil drain port formed in the bottom wall of each of the individual crank chambers respectively;

a scavenging oil pump pumping out oil to an oil reservoir portion which is isolated from each of the individual crank chambers; and an oil collecting chamber communicating with a suction portion of the scavenging oil pump, wherein the oil collecting chamber is positioned under the bottom wall of the crank chamber, and the oil drain ports are communicated with the oil collecting chamber.

2. The lubricating system of the engine as claimed in claim 1, wherein the oil collecting chamber is formed within the oil pan, and at least one of the oil drain ports is communicated with the oil collecting chamber via an oil collecting passage formed in the bottom wall of the crank chamber.

3. The lubricating system of the engine as claimed in claim 2, wherein the oil collecting passage comprises a passage forming groove formed in the bottom wall of the crank chamber, and a bottom plate, a lower end of the passage forming groove is opened, the bottom plate closes the lower opening end of the passage forming groove.

4. The lubricating system of the engine as claimed in claim 2, wherein an oil piping space is formed between the bottom wall of the crank chamber and the oil pan, the oil collecting passage is formed within the oil piping space, and an oil supply pipe for supplying the oil to each of lubricating positions of the engine is provided in the oil piping space.

5. The lubricating system of the engine as claimed in claim 3, wherein a mounting face for the oil collecting chamber in the oil pan is formed in the oil pan mounting portion of the crank case, the mounting face corresponds to an upper end of a peripheral wall of the oil collecting chamber, a portion of the mounting face is opened so as to communicate the passage forming groove to the oil collecting chamber, and a mounting face supplement member which forms approximately the same surface as the mounting face is mounted to the opening portion of the mounting face.

6. The lubricating system of the engine as claimed in claim 1, wherein a strainer is provided in the oil collecting chamber.

7. The lubricating system of the engine as claimed in claim 1, wherein a lower portion of a transmission room within the crank case is formed as the oil reservoir portion, an oil suction chamber isolated from the oil collecting chamber is formed in a lower portion than the bottom wall of the crank chamber, and the oil suction chamber is communicated with a suction portion of a feed oil pump for supplying the oil to each of lubricating positions of the engine, and is communicated with the oil reservoir portion.

8. The lubricating system of the engine as claimed in claim 7, wherein the scavenging oil pump and the feed oil pump are arranged in the transmission room, and a discharge portion of the feed oil pump is communicated with a main gallery via an oil supply pipe, for supplying the oil to each of lubricating positions of the engine, arranged within an piping space formed between the bottom wall of the crank chamber and the oil pan.

9. The lubricating system of the engine as claimed in claim 1, wherein an oil collecting passage is provided under the bottom wall so as to flow the oil from the drain port to the oil collecting chamber, a regulating hole is provided to the oil collecting passage or the bottom wall so as to communicate the oil collecting chamber with the oil reservoir portion, and a cross sectional area of the regulating hole is set such that an amount of the oil flowing to the oil collecting chamber from the oil reservoir portion through the regulating hole and the oil collecting passage becomes smaller than an amount of the oil pumped out to the oil reservoir portion from the oil collecting chamber by the scavenging oil pump.

10. The lubricating system of the engine as claimed in claim 9, wherein the oil reservoir portion is provided with an oil inspection window through which an oil level within the oil reservoir portion is visible from the outside.

11. A semidry sump type lubricating system of an engine in which a lower portion of a transmission room of a crank case is formed as an oil reservoir portion isolated from a crank chamber, comprising:

an oil collecting chamber positioned under a bottom wall of the crank chamber;

a scavenging oil pump pumping out oil from the oil collecting chamber to the oil reservoir portion;

a feed oil pump for supplying the oil from the oil reservoir portion to each of lubricating positions of the engine;

an oil collecting passage provided under the bottom wall so as to flow the oil from a drain port of the crank chamber to the oil collecting chamber, and a regulating hole provided to the oil collecting passage or the bottom wall so as to communicate the oil collecting chamber with the oil reservoir portion, wherein a cross sectional area of the regulating hole is set such that an amount of the oil flowing to the oil collecting chamber from the oil reservoir portion through the regulating hole and the oil collecting passage becomes smaller than an amount of the oil pumped out to the oil reservoir portion from the oil collecting chamber side by the scavenging oil pump.

12. The semidry sump type lubricating system of the engine as claimed in claim 11, wherein the regulating hole is formed bottom portion of the oil collecting passage.

13. The semidry sump type lubricating system of the engine as claimed in claim 12, wherein the oil collecting passage comprises a passage forming groove formed the bottom wall of the crank chamber, and a bottom plate closing a lower opening end of the passage forming groove, the regulating hole is formed to the bottom plate.

14. The semidry sump type lubricating system of the engine as claimed in claim 11, wherein the oil reservoir portion is provided with an oil inspection window through which an oil level within the oil reservoir portion is visible from the outside.

* * * * *